US007290511B2

(12) United States Patent
Tashiro

(10) Patent No.: US 7,290,511 B2
(45) Date of Patent: Nov. 6, 2007

(54) VALVE TRAIN FOR INTERNAL COMBUSTION ENGINE

(75) Inventor: Masahiko Tashiro, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/587,951

(22) PCT Filed: Feb. 17, 2005

(86) PCT No.: PCT/JP2005/002966

§ 371 (c)(1),
(2), (4) Date: Aug. 2, 2006

(87) PCT Pub. No.: WO2005/078246

PCT Pub. Date: Aug. 25, 2005

(65) Prior Publication Data

US 2007/0125328 A1 Jun. 7, 2007

(30) Foreign Application Priority Data

Feb. 17, 2004 (JP) ..... 2004-040248

(51) Int. Cl.
*F01L 1/34* (2006.01)

(52) U.S. Cl. ..... 123/90.16; 123/90.17; 123/90.15; 123/90.31

(58) Field of Classification Search ..... 123/90.16
See application file for complete search history.

(56) References Cited

U.S. PATENT DOCUMENTS 6,990,938 B2 * 1/2006 Inomoto et al. ..... 123/90.16
7,104,231 B2 * 9/2006 Tashiro ..... 123/90.16
7,121,239 B2 * 10/2006 Tashiro ..... 123/90.16
2002/0007809 A1 1/2002 Miyazato et al.

FOREIGN PATENT DOCUMENTS

| | | |
|---|---|---|
| EP | 2002-235515 | 8/2002 |
| GB | 2 186 337 A | 8/1987 |
| JP | 7-91217 A | 4/1995 |
| WO | 2004/009967 A1 | 1/2004 |

* cited by examiner

*Primary Examiner*—Thomas Denion
*Assistant Examiner*—Kyle M. Riddle
(74) *Attorney, Agent, or Firm*—Arent Fox LLP

(57) ABSTRACT

A valve train includes a primary rocker arm 50 which is oscillated about a primary oscillating center line L4 by an inlet cam 21, a secondary rocker arm 60 which transmits a valve drive force F1 to an inlet valve 14 and oscillates about a secondary oscillating center line L5, and a holder 30 which supports the primary and secondary rocker arms 50, 60 in such a manner that the primary and secondary oscillating center lines L4, L5 rotate together therewith. As the holder 30 approaches an oscillating position where a valve operating property is obtained where a maximum lift amount becomes maximum, an abutment position P1 where a cam lobe portion 21*b* abuts with a roller 53 of the primary rocker arm 50 approaches a specific straight line L10 which passes through a holder oscillating center line L3 and a rotational center line L2 of the inlet cam 21.

4 Claims, 9 Drawing Sheets

VALVE TRAIN FOR INTERNAL COMBUSTION ENGINE

CROSS-REFERENCE TO RELATED APPLICATION

This application is a National Stage entry of International Application No. PCT/JP2005/002966, filed Feb. 17, 2005, the entire specification claims and drawings of which are incorporated herewith by reference.

TECHNICAL FIELD

The present invention relates to a valve train for an internal combustion engine, and more particularly to a valve train which can change the valve operating properties including opening and closing timings and maximum lift amount of an engine valve made up of at least one of an inlet valve and an exhaust valve.

BACKGROUND ART

As a valve train for an internal combustion engine in which the valve operating properties of an engine valve are changed in accordance with an oscillating position of an oscillating member which supports a transmission mechanism which transmits the valve drive force of a valve operating cam to the engine valve, there is a valve train disclosed, for example, in Japanese Patent Unexamined Publication No. JP-A-7-91217. The valve train disclosed in the JP-A-7-91217 includes a drive shaft which is driven to rotate by an internal combustion engine, a camshaft which is disposed rotatably on an outer circumference of the drive shaft and which is provided rotatably on a cylinder head, a cam formed on the camshaft, a disk housing adapted to oscillate in a radial direction relative to the drive shaft about a pivot pin acting as a fulcrum, an annular disk which is rotatably supported on an inner circumferential surface of the disk housing, a drive mechanism for oscillating the disk housing and a rocker arm which is pivot supported on a rocker shaft which is supported, in turn, on the disk housing at one end portion thereof and which abuts with the cam and an inlet valves.

Then, when the disk housing is caused to oscillate by the drive mechanism, the center of the annular disk becomes eccentric to the axial center of the drive shaft, so that the rotational phase difference and rotational angular velocity ratio of the cam and the drive shaft change, whereby the operation angle of the inlet valve is changed. At the same time, the pivot fulcrum position of the rocker arm is changed through the displacement of the rocker shaft which oscillates together with the disk housing, and the other end portion of the rocker arm shits over an upper surface of a valve lifter along a diametrical direction thereof, whereby a rocker ratio relative to the inlet valve is changed so that the valve lift amount is changed.

In the related art disclosed in the JP-A-7-91217, since a cam abutment position between the cam and the rocker arm is situated substantially on a straight line which passes a rotational center line of the cam and an oscillating center line of the disk housing on a plane which intersects with the oscillating center line at right angles, a moment acting on the disk housing based on a valve drive force acting at the cam abutment position is reduced when the rocker arm is in abutment with a lobe portion of the cam, whereby the drive force of the drive mechanism which is necessary to oscillate the disk housing is reduced. However, since the rocker arm abuts with both the cam and the inlet valve, the related art has the following drawbacks.

Namely, when attempting to maintain the closed state of the inlet valve with the rocker arm being allowed to abut with a base circle of the cam, since the cam abutment position cannot be shifted largely on the base circle of the cam, the oscillating amount of the pivot support position of the rocker arm by virtue of oscillation of the disk housing is limited to a relatively small value, and this disables a large change in rotational phase difference, rotational angular velocity ratio and rocker ratio, thereby making it difficult to increase the control range of the opening and closing timings and maximum lift amount of the inlet valve. In addition, since the pivot fulcrum position and pivot pin position are determined unconditionally from the positional relation between the cam and the inlet valve, the degree in freedom in arrangement of the rocker arm and the pivot pin is limited, and with, for example, an internal combustion engine having a relatively compact cylinder head, the interference of the valve train with peripheral members of the engine which are disposed therearound cannot be avoided, and it becomes difficult to dispose the valve train of the related art within the limited space, resulting in the possible occurrence of a risk that the related art valve train cannot be adopted for the aforesaid internal combustion engine. In addition, when attempting to have a specific positional relation between the abutment position of the rocker arm with the inlet valve and the oscillating center line, in addition to the positional relation among the cam abutment position, the rotational center line and the oscillating center line, the degree of freedom is reduced further.

DISCLOSURE OF THE INVENTION

The present invention was made in view of the situations. An object of the present invention is to provide a valve train for an internal combustion engine including a transmission mechanism for transmitting a valve drive force of a valve operating cam to an engine valve and in which valve operating properties are changed in accordance with an oscillating position of a holder of the transmission mechanism, wherein a drive mechanism for oscillating the holder can be made compact in size by reducing the drive force of the drive mechanism, and wherein the control range of the valve operating properties can be set large and the degree of freedom in arrangement of the transmission mechanism can be increased. Also, another object of the present invention is to provide a valve train which can suppress the progress in wear of a valve abutment portion or the engine valve due to the oscillation of the holder. Furthermore, the other object of the present invention is to reduce further the drive force of the drive mechanism.

According to a first aspect of the present invention, there is provided a valve train for an internal combustion engine, comprising:

a valve operating cam rotating around a rotational center line in synchronism with a rotation of an engine;

an engine valve including at least one of an inlet valve and an exhaust valve;

a transmission mechanism for transmitting a valve drive force of the valve operating cam to the engine valve so as to operate the engine valve in opening and closing states, the transmission mechanism including:

a primary oscillating member having an abutment portion which abuts with the valve operating cam, and oscillating about a primary oscillating center line by the valve operating cam;

a secondary oscillating member having a valve abutment portion which abuts with the engine valve, transmitting the valve drive force via the primary oscillating member to the engine valve, and oscillating about a secondary oscillating center line;

a holder supporting the primary and secondary oscillating members in an oscillatory fashion so that the primary and secondary oscillating center lines rotate together therewith, and oscillating about a holder oscillating center line which differs from the rotational center line of the valve operating cam;

a drive mechanism for driving the holder so as to control valve properties including opening and closing timings and maximum lift amount of the engine valve in accordance with an oscillating position of the holder;

wherein as the oscillating position of the holder approaches a predetermined position where the maximum lift amount of the valve operating property becomes maximum is obtained, a cam abutment position where a cam lobe portion of the valve operating cam and the cam abutment portion abut with each other approaches a specific straight line which passes through the holder oscillating center line and the rotational center line.

According to the construction, since the line of action of the valve drive force is situated on the specific straight line when the cam abutment position lies on the specific straight line, the moment becomes zero which is generated around the holder oscillating center line to act on the holder based on the valve drive force applied via the primary oscillating member. From this fact, while the valve drive force is increased because the maximum lift amount is increased as the holder approaches the oscillating position where the valve property is obtained where the maximum lift amount of the engine valve becomes maximum, the moment acting on the holder can be reduced by the approach of the cam abutment position on the cam lobe portion to the specific straight line, whereby the drive force of the drive mechanism which oscillates the holder against the moment can be reduced. In addition, the abutment state between the valve operating cam and the engine valve can be set by the separate oscillating member due to the primary and secondary oscillating members abutting with the valve operating cam and the engine valve, respectively, and the primary and secondary oscillating center lines oscillate together with the holder. Consequently, even in the event that the shift amount of one of the primary and secondary oscillating members is increased by virtue of the oscillation of the holder in order to set the control range of the valve operating properties large, when compared with a case while one of the primary and secondary oscillating center lines shifts, the other does not, the relative shift amount of the primary and secondary oscillating members can be suppressed to a small level.

According to a second aspect of the present invention as set forth in the first aspect of the present invention, it is preferable that the valve abutment portion having a valve abutment surface which abuts with the engine valve is provided at a position which intersects with the holder oscillating center line.

According to the construction, since the valve abutment surface resides close to the holder oscillating center line, even in the event that the valve abutment position which is the abutment position of the valve abutment surface with the engine valve shifts due to the oscillation of the secondary oscillating center line which is triggered by the oscillation of the holder, the resulting shift amount is reduced, thereby making it possible to reduce the size of the valve abutment portion.

According to a third aspect of the present invention as set forth in the first aspect of the present invention, it is more preferable that the valve abutment portion abuts with a valve shaft of the engine valve, the holder oscillating center line is disposed on an extension of the valve shaft which extends along an axis of the valve shaft, and when the cam abutment position is situated at an apex of the cam lobe portion, the cam abutment position is situated on the specific straight line.

According to the construction, since the distance between the holder oscillating center line disposed on the extension of the valve shaft and the line of action of the reaction force from the engine valve is maintained small within the range of the valve shaft, a moment acting on the holder based on the reaction force of the engine valve can be reduced. In addition, when a maximum valve operating force acts at a specific oscillating position of the holder, since the moment acting on the holder based on the valve drive force becomes zero, the drive force of the drive mechanism which oscillates the holder against the moment can be reduced.

According to a fourth aspect of the present invention as set forth in the first aspect of the present invention, it is further preferable that the valve abutment portion abuts with a valve shaft of the engine valve, the holder oscillating center line is disposed on an extension of the valve shaft which extends along an axis of the valve shaft, and the cam abutment portion is disposed such that the cam abutment position is capable of being situated on the specific straight line which passes through the holder oscillating center line and the rotational center line.

According to the construction, since the distance between the holder oscillating center line disposed on the extension of the valve shaft and the line of action of the reaction force from the engine valve is maintained small within the range of the valve shaft, a moment acting on the holder based on the reaction force of the engine valve can be reduced. In addition, in the state where the cam abutment position on the cam lobe portion resides on the specific straight line or in the vicinity thereof, the moment acting on the holder based on the valve drive force can be reduced, and therefore, the drive force of the drive mechanism which oscillates the holder against the moment can be reduced.

According to the invention set forth in the first aspect, the following advantages are provided. Namely, since the drive force of the drive mechanism for oscillating the holder can be reduced, the drive mechanism is made compact in size. Since the abutment state of the valve operating cam with the engine valve can be set by the separate oscillating member, the degree of freedom in arrangement of the transmission mechanism, so that the scope of application of the invention can be expanded. In addition, since the relative shift amount of the primary and secondary oscillating members can be suppressed to a small level, the control range of the valve operating properties can be set large.

According to the invention set forth in the second aspect, in addition to the advantages provided the first aspect referred to therein, the following advantages are provided. Namely, since the shift amount is small even in the event that the valve abutment position is caused to shift due to the oscillation of the holder, the progress in wear of the valve abutment surface attributed to the oscillation of the holder is suppressed. In addition, since the valve abutment portion can be made small in size, the secondary oscillating member is miniaturized.

According to the invention set forth in the third aspect, in addition to the advantages provided the second aspect referred to therein, the following advantages are provided. Namely, since the moment acting on the holder based on the reaction force of the engine valve can be reduced, in this respect, too, the invention can contribute to the reduction in drive force of the drive mechanism. In addition, since the moment acting on the holder based on a maximum valve drive force at a specific oscillating position becomes zero, the drive force of the drive mechanism can be reduced further, thereby making the drive mechanism compact.

According to the invention set forth in the fourth aspect, in addition to the advantages provided the third aspect referred to therein, the following advantages are provided. Namely, since the moment acting on the holder based on the reaction force of the engine valve can be reduced, in this respect, too, the invention can contribute to the reduction in drive force of the drive mechanism. In addition, since the moment acting on the holder based on the valve drive force becomes zero, the drive force of the drive mechanism can be reduced further, thereby making the drive mechanism compact.

BEST MODE FOR CARRYING OUT THE INVENTION

Embodiments of the invention will be described below by reference to FIGS. 1 to 9.

Figure 1:
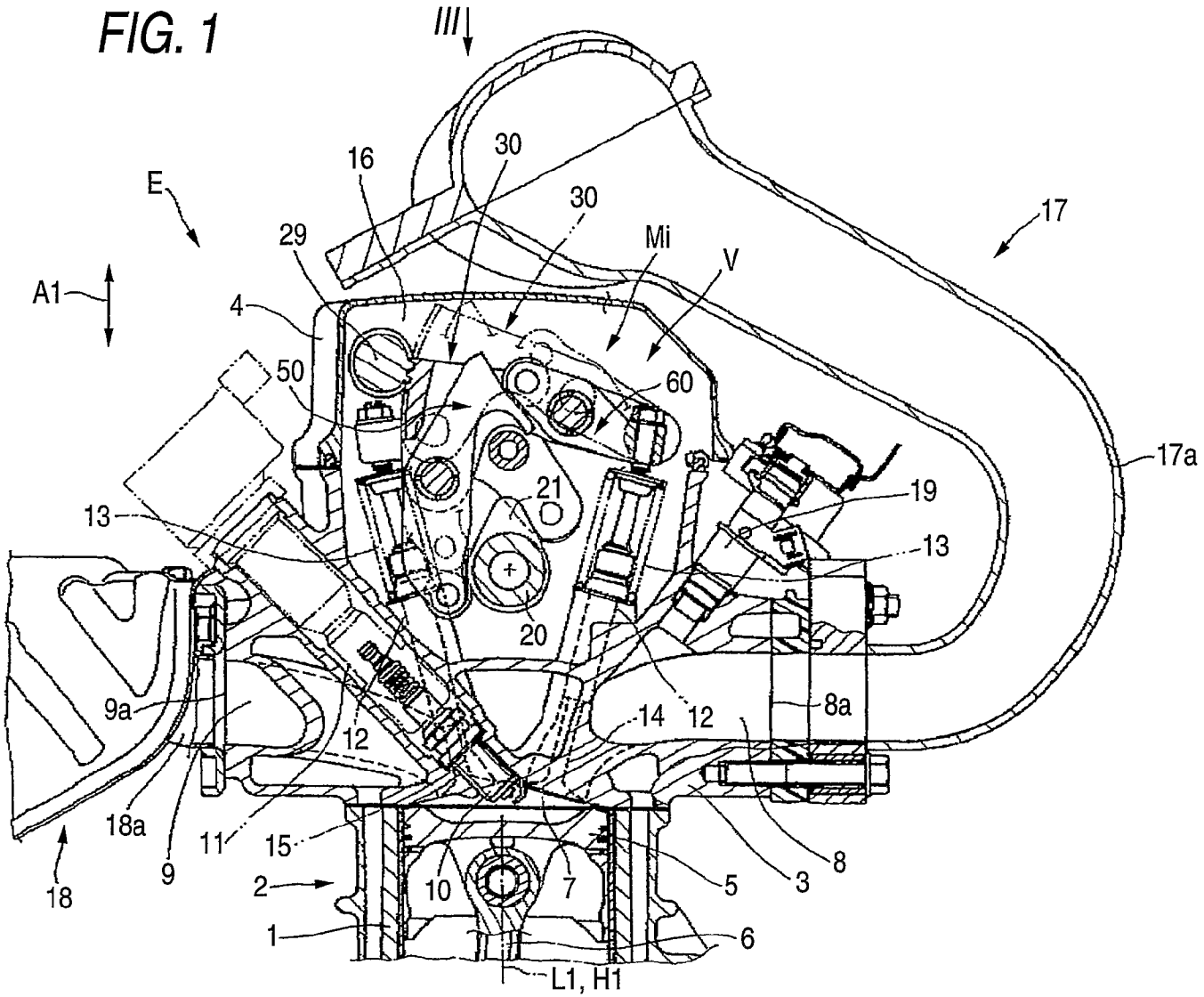
FIG. 1 is a sectional view of a main part of an internal combustion engine having a valve train of the invention, which shows a first embodiment of the invention.

FIGS. 1 to 8 are drawings which describe a first embodiment of the invention. Referring to FIG. 1, an internal combustion engine E provided with a valve train of the invention is an overhead camshaft, water-cooled, in-line four-cylinder, four-stroke internal combustion engine, and is installed transversely in a vehicle in such a manner that a crankshaft thereof extends in a transverse direction of the vehicle. The internal combustion engine E includes a cylinder block 2 in which four cylinders 1 are formed integrally, a cylinder head 3 connected to an upper end portion of the cylinder block 2 and a cylinder head cover 4 connected to an upper end portion of the cylinder head 3, the cylinder block 2, the cylinder head 3 and the cylinder head cover 4 making up an engine main body of the internal combustion engine E.

Note that in this specification, it is understood that a vertical direction denotes a direction which coincides with a cylinder axis direction A1 of the cylinder 1 and that upward denotes a direction in which the cylinder head 3 is disposed relative to the cylinders 1 in the cylinder axis direction A1. In addition, a sectional shape means a sectional shape in a plane (hereinafter, simply referred to as an orthogonal plane) which intersects at right angles with a holder oscillating center line L3, a primary oscillating center line L4, a secondary oscillating center line L5 or a rotational center line L2, all of which will be described later on. Then, this orthogonal plane also constitutes an oscillating plane which is a plane parallel to an oscillating direction of a holder 30, a primary rocker arm 50 or a secondary rocker arm 60, all of which will be described later on.

A cylinder bore is formed in each cylinder 1 in which a piston 5 connected to the crankshaft by a connecting rod 6 fits in such a manner as to reciprocate freely therein. In the cylinder head 3, a combustion chamber 7 is formed in a surface which faces the cylinder bores in the cylinder axis direction A1 in such a manner as to correspond to each cylinder 1, respectively, and an inlet port 8 having a pair inlet openings and an exhaust port 9 having a pair of exhaust openings are also formed in the cylinder head 3 in such a manner as to open to each combustion chamber 7. A spark plug 10 is installed in the cylinder head 3 in such a manner as to be inserted into an insertion hole formed in the cylinder 3 on an exhaust side thereof together with an ignition coil 11 connected to the spark plug 10.

Here, the inlet side of the internal combustion engine E means a side where an inlet valve 14 or an entrance 8*a* to the inlet port 8 is disposed relative to a reference plane H1 which includes cylinder axes L1 and which is parallel to a rotational center line L2 of an inlet cam 21 and an exhaust cam 22 which also constitutes a rotational center line L2 of a camshaft 20, and the exhaust side of the internal combustion engine E means a side where an exhaust valve 15 or an exit 9*a* from the exhaust port 9 is disposed. Then, the inlet side is one of one side and the other side relative to the reference plane Hi, whereas the exhaust side is the other of the one side and the other side.

In the cylinder head 3, a pair of inlet valves 14 functioning as primary engine valves and a pair of exhaust valves 15 functioning as secondary engine valves are provided for each cylinder 1, the inlet valves 14 and the exhaust valves 15 each being made up of a poppet valve which is supported in a valve guide 12 in such a manner as to reciprocate therein and is biased in a normally closed direction. The pair of inlet valves 14 and the pair of exhaust valves 15 which belong to each cylinder 1 are operated to be opened and closed by a valve train V so as to open and close the pair of inlet openings and the pair of exhaust openings, respectively. The valve train V, excluding an electric motor 28 for driving a drive shaft 29, which will be described later on, is disposed within a valve chamber 16 defined by the cylinder head 3 and the cylinder head cover 4.

The internal combustion engine E includes further inlet system 17 and an exhaust system 18. The inlet system 17, which includes an air cleaner, a throttle valve and an inlet manifold 17*a* for induction of air for combustion into the inlet port 8, is mounted on a side on the inlet side of the cylinder head 3 to which the openings 8*a* of each port 8 are made to open, whereas the exhaust system 18, which includes an exhaust manifold 18*a* for guiding exhaust gases flowing thereinto from the combustion chambers 7 via the exhaust ports 9 to the outside, is mounted on a side on the exhaust side of the cylinder head 3 to which the openings 9*a* of each exhaust port 9 are made to open. In addition, a fuel injection valve 19, which is a fuel supply system for supplying fuel for intake air, is installed in the cylinder head 3 in such a manner as to be inserted into an insertion hole provided on the inlet side of the cylinder head 3 so as to face the inlet port 8 of each cylinder 1.

Then, air drawn in through the inlet system 17 is drawn further into the combustion chamber 7 from the inlet port 8 via the inlet valves 14 which are opened in an induction stroke where the piston 5 descends and is compressed in a compression stroke where the piston 5 ascends in a state in which the air is mixed with fuel. The air/fuel mixture is ignited by the spark plug 10 in a final stage of the compression stroke for combustion, and the piston 5, which is driven by virtue of the pressure of combustion gases in a power stroke where the piston descends, drives and rotates the crankshaft via the connecting rod 6. Combustion gases are discharged from the combustion chamber 7 into the exhaust port 9 as exhaust gases via the exhaust valves 15 which are opened in an exhaust stroke where the piston 5 ascends.

Figure 2:
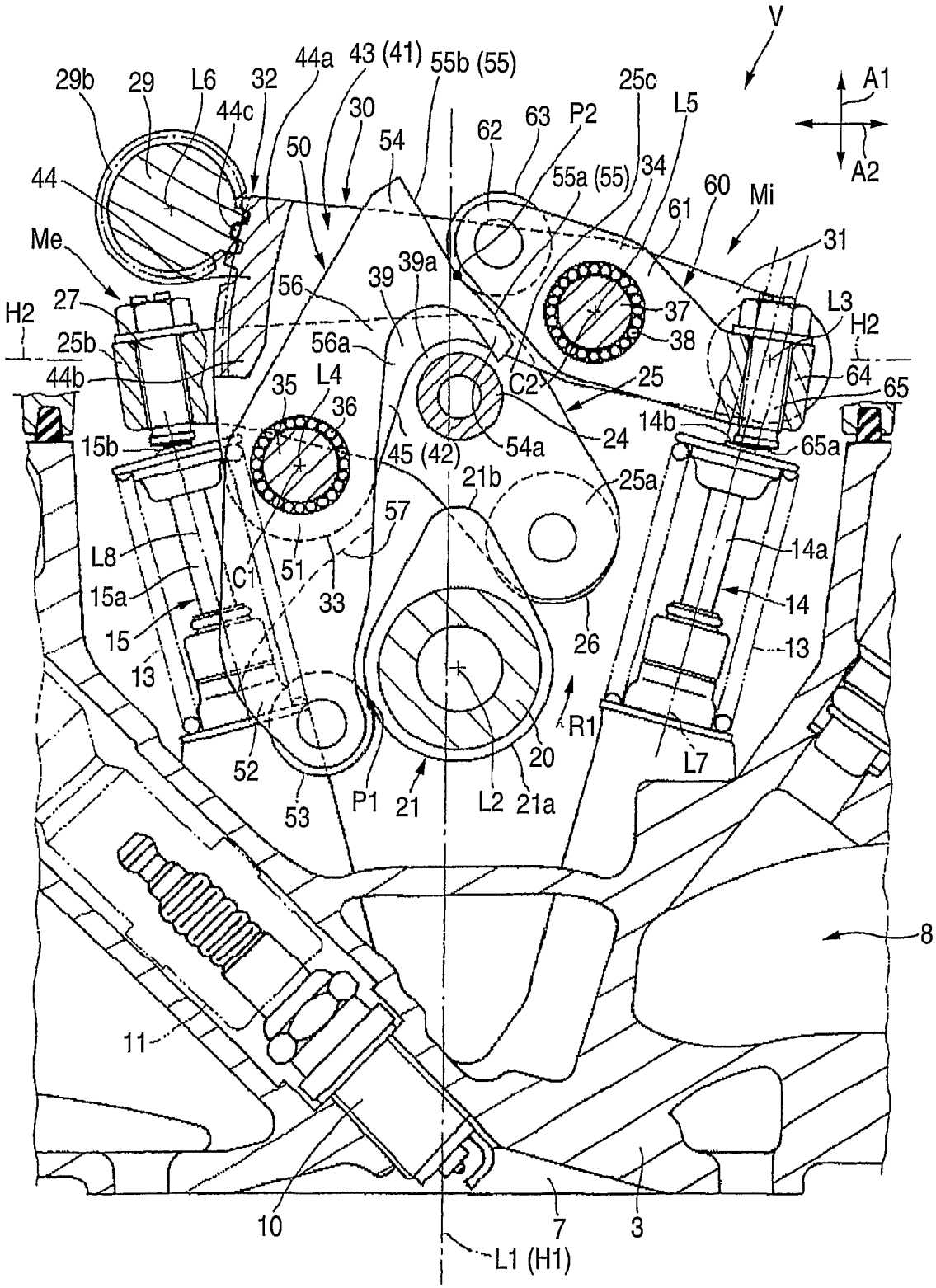
FIG. 2 is an enlarged view of the main part in FIG. 1, which is a sectional view taken along the line indicated by arrows IIa-IIa and as viewed in a direction indicated by the same arrows in FIG. 3 as to a cylinder head, and which is a sectional view taken along the line indicated by arrows IIb-IIb and as viewed in a direction indicated by the same arrows in FIG. 3 as to a transmission mechanism.

Referring to FIG. 2, the valve train V provided on the cylinder head 3 includes a single camshaft 20 which is rotatably supported on the cylinder head 3 in such a manner as to have a rotational center line L2 which is parallel to the rotational center line of the crankshaft, and further includes an inlet cam 21 which is a primary valve operating cam provided on the camshaft 20 so as to rotate together with the camshaft 20 and exhaust cams 22 (refer to FIG. 3) which constitutes a pair of secondary valve operating cams, an inlet operation mechanism for actuating the inlet valves 14 to be opened and closed in response to the rotation of the inlet cam 21, and an exhaust operation mechanism for actuating the exhaust valves 15 to be opened and closed in response to the rotation of the exhaust cams. Then, in this embodiment, the inlet operation mechanism is made up of variable properties mechanism which can control the valve operating properties including opening and closing timings and maximum lift of the inlet valves 14 in accordance with the operating state of the internal combustion engine E.

Figure 3:
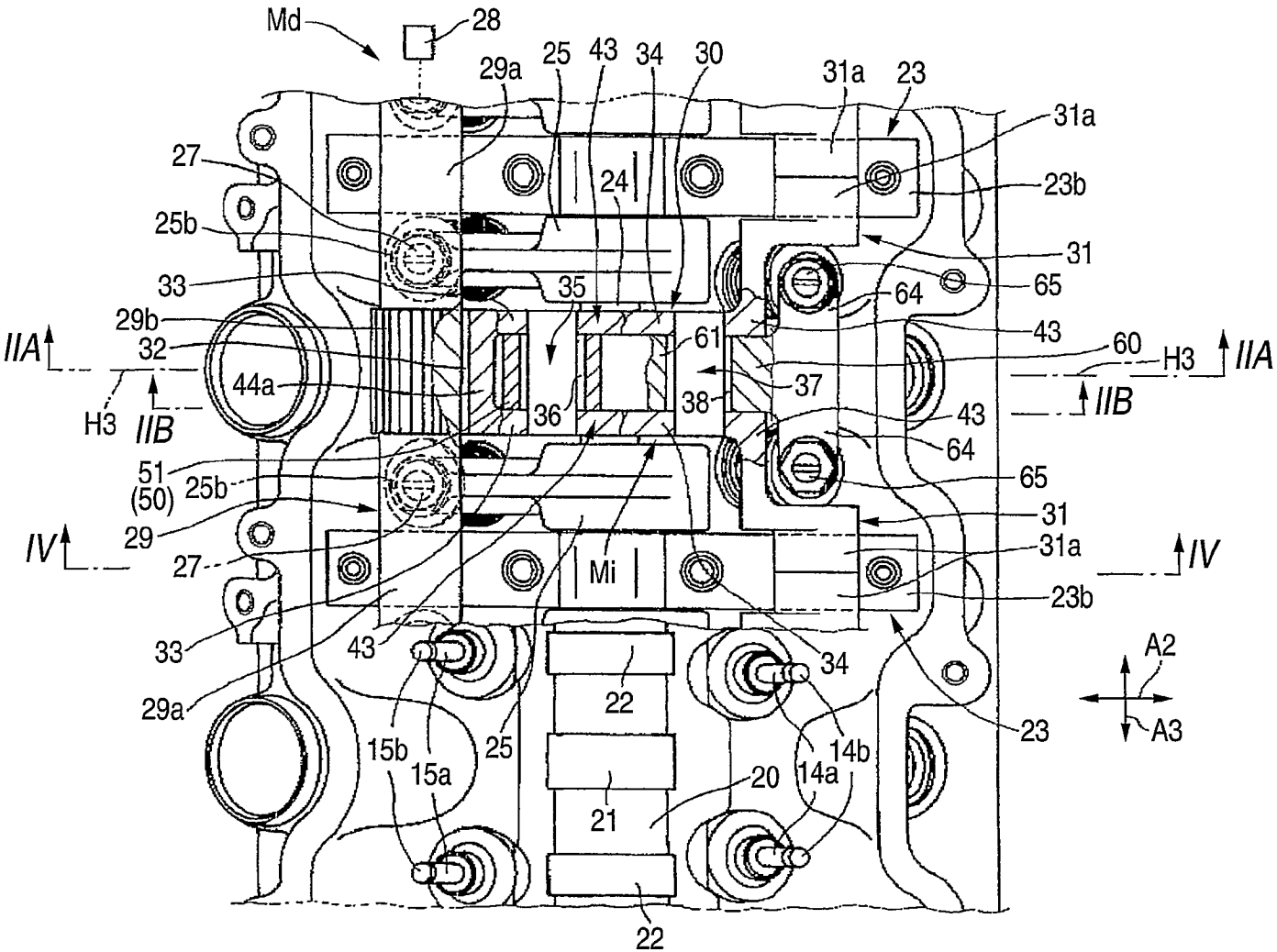
FIG. 3 is a view of the valve train with a cylinder head cover of the internal combustion engine being removed, as viewed in a direction indicated by an arrow III in FIG. 1.
Figure 4:
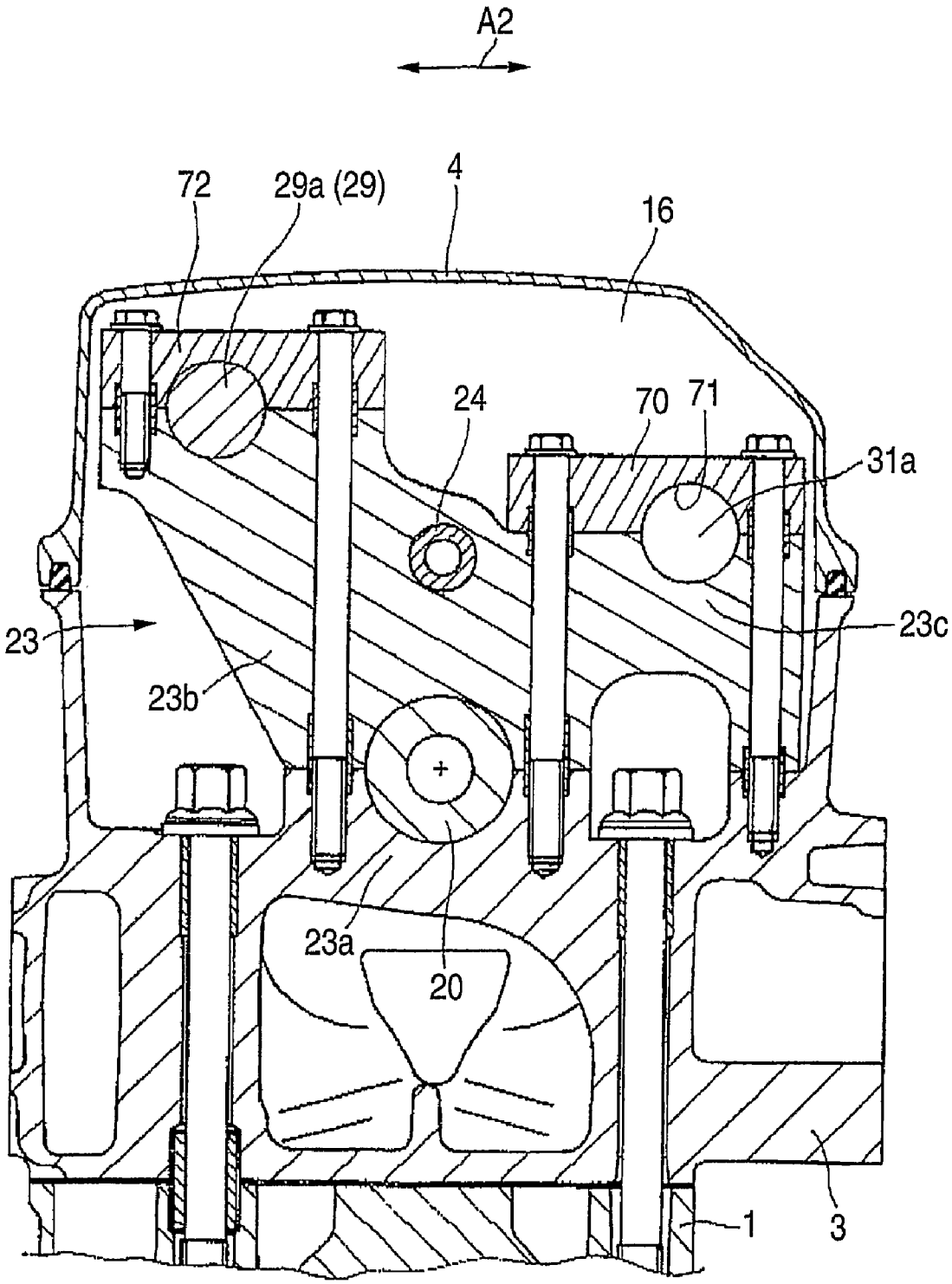
FIG. 4 is a sectional view taken along the line indicated by arrows IV-IV and as viewed in a direction indicated by the same arrows in FIG. 3.

Referring to FIGS. 2 to 4, the camshaft 20, which is situated between the inlet valves 14 and the exhaust valves 15 in an orthogonal direction A2 relative to the reference plane H1, which intersects at right angles with the reference plane H1 and which is situated closer to a lower wall of the valve chamber 16, is supported rotatably on a camshaft holder which is provided integrally on the cylinder head 3. The camshaft holder has a plurality of, here, five, bearing portions 23 which are provided on the cylinder head 3 at certain intervals in a rotational center line direction A3. Each bearing portion 23 is made up of a bearing wall 23*a* which is formed integrally on the cylinder head 3 and a bearing cap 23*b* which is connected to the bearing wall 23*a*. The camshaft 20 is driven to rotate at half crankshaft rotational speed, while interlocked therewith, by virtue of the power of the crankshaft which is transmitted via a valve operating transmission mechanism including a chain which is an endless transmission belt extended between a shaft end portion of the crankshaft and a shaft end portion of the camshaft 20. Consequently, the camshaft 20, the inlet cams 21 and the exhaust cams 22 rotate in synchronism with the rotation of the crankshaft, which is the rotation of the engine. In addition, the single inlet cam 21 is disposed between the pair of exhaust cams 22 in the rotational center line direction A3.

The exhaust operation mechanism includes a transmission mechanism Me which transmits a valve drive force of the exhaust cam 22 to each exhaust valve 15 so as to actuate the exhaust vale 15 to be opened and closed. The transmission mechanism Me includes a rocker shaft 24 as a single support shaft which is disposed directly above the camshaft 20 so as to be in parallel with the camshaft 20 and to intersect at right angles with the reference plane H1 and which is fixedly supported on each bearing cap 23*b* and exhaust rocker arms 25 which are tertiary rocker arms as a pair of tertiary oscillating members. Each rocker arm 25, which is supported in an oscillatory fashion at a fulcrum portion 25*c* on the rocker shaft 24 functioning as a pivot support portion, abuts with the exhaust cam 22 via a roller 26 possessed by a cam abutment portion 25*a* which is made up of an end portion of the exhaust rocker arm 25 and abuts with a valve stem 15*a* as a valve shaft of the exhaust valve 15 via an adjustment screw 27 possessed by a valve abutment portion 25*b* which is made up of the other end portion the exhaust rocker arm 25. Here, in the exhaust rocker arm 25, the valve abutment portion 25*b* is a location positioned closer to the exhaust valve 15 and is also a location positioned on an extension of a valve spring 13 in a direction in which the valve spring 13 extends and contracts (a direction in parallel with an axis L8, which will be described later on). Then, in the exhaust rocker arm 25, the fulcrum portion 25*c* is provided at an intermediate portion, which is a location between the cam abutment portion 25*a* and the cam abutment portion 25*b*. The adjustment screw 27 and an adjustment screw 65, which will be described later on, are such as to adjust the valve clearance to an appropriate value.

The inlet operation mechanism includes a transmission mechanism Mi for transmitting a valve drive force F1 (refer to FIG. 6) of the inlet cam 21 to each inlet valve 14 so as to actuate the inlet valve 14 to be opened and closed and a drive mechanism Md having an electric motor 28 as an actuator for driving a movable holder 30 provided on the transmission mechanism Mi, whereby the valve operating properties of the inlet valve 14 are controlled in accordance with the shift position of the holder 30 which is driven to shift by the drive mechanism Md.

The transmission mechanism Mi includes the holder 30 which is supported in such a manner as to oscillate about the holder oscillating center line L3 which is parallel to the rotational center line L2 relative to the cylinder head 3 so as to oscillate in response to the operation of the electric motor 28, a primary rocker arm 50 as a primary oscillating member which is supported in such a manner as to oscillate about the primary oscillating center line L4 so as to oscillate in response to the rotation of the inlet cam 21 and a secondary rocker arm 60 as a secondary oscillating member which is supported on the holder in such a manner as to oscillate about the secondary oscillating center line L5 so as to oscillate in response to the oscillation of the primary rocker arm 50. The secondary rocker arm 60 transmits the valve drive force F1 transmitted thereto via the primary rocker arm 50 to the inlet valve 14. Therefore, in this embodiment, an inlet rocker arm for actuating the inlet valve 14 to be opened and closed is made up of a plurality of rocker arms, here, a group of rocker arms which is made up of the primary and secondary rocker arms 50, 60.

The drive mechanism Md includes the electric motor 28, which is mounted on the cylinder head cover 4 outside the valve chamber 16, and the drive shaft 29 which is supported in such a manner as to oscillate relative to the cylinder head 3 so as to be driven to rotate by the reversible electric motor 28 to thereby oscillate the holder 30.

Here, the primary and secondary oscillating center lines L4, L5 and a rotational center line L6 of the drive shaft 29 are parallel to the holder oscillating center line L3, which differs from the rotational center line L2 of the inlet cam 21 and the exhaust cam 22. In addition, the holder oscillating center line L3 and the rotational center line L2 are situated on the inlet side, whereas the rotational center line L6 is situated on the exhaust side.

Referring to FIGS. 2, 3, the holder 30, which is disposed between the pair of bearing portions 23 which are adjacent to each other in the rotational center line direction A3 above the camshaft 20 for each cylinder 1, includes a fulcrum portion 31 which is situated on the inlet side of the cylinder head 3 and is pivot supported on the bearing cap 23*b*, a gear portion 32 as an acting portion which is situated on the exhaust side of the cylinder head 3 and on which the drive force of the electric motor 28 acts via the drive shaft 29 and primary and secondary support portions 33, 34 which are disposed between the holder oscillating center line L3 and the gear portion 32 in the orthogonal direction A2 and which support the primary and secondary rocker arms 50, 60, respectively. In addition, almost the whole of the transmission mechanism Mi is disposed within an triangle having the rotational center line L2, the holder oscillating center line L3 and the rotational center line L6 as three vertexes thereof (refer to FIG. 2) when viewed from the rotational center line direction A3 (hereinafter, referred to as when viewed sideways).

The holder 30, which appears something like an L-shape which bends downwardly toward the inlet cam 21 when viewed sideways, has an arm-like base portion 41 which extends linearly from the holder oscillating center line L3 toward the gear portion 32 and a projecting portion 42 which projects from the base portion 41 in a direction to approach the inlet cam 21. The base portion 41 is made up of a pair of side walls 43 which face each other in the rotational center line L3 and a part 44*a* of a connecting wall 44 which connects the two side walls 43 together and which makes up an outermost end portion of the holder 30 in a radial direction which radiates from the holder oscillating center line L3 as a center. In addition, the projecting portion 42 is made up of a pair of projecting walls 45 extending downwardly from the respective side walls 43 and the remaining part 44*b* of the connecting wall 44 which connects the pair of projecting walls 45 at portions thereof which are situated closer to the base portion 41.

The base portion 41 is disposed above the camshaft 20, the inlet cam 21 and the rocker shaft 24 in such a manner as to extend substantially in the orthogonal direction A2 from the inlet side to the exhaust side, the fulcrum portion 31 is disposed substantially at the same position as a valve abutment portion, which will be described later on, in the orthogonal direction A2, and the holder oscillating center line L3 is disposed on an extension (in FIG. 2, the extension is shown by chain double-dashed lines) of a valve stem 14*a* as a valve shaft of the inlet valve 14 which extends along an axis L7 of the valve stem 14*a*. By adopting this construction, a distance between the holder oscillating center line L3 and a line of action of a reaction force F2 (refer to FIG. 6) from the inlet valve 14 is maintained small within the range of the valve stem 14*a* as a maximum limit. On the other hand, the projecting portion 42, which is disposed to extend substantially in the cylinder axis direction A1, is always situated on the exhaust side within the oscillating range of the holder 30.

The fulcrum portion 31 and the secondary support portion 34 are provided on each side wall 43, the gear portion 32 is provided on the connecting wall 44 in such a manner as to extend from the base portion 41 to the projecting portion 42, and the primary support portion 33 is provided on each projecting wall 45. As shown in FIG. 4, the fulcrum portion 31 is pivot supported on a support portion 23*c* formed on the bearing cap 23*b*. The support portion 23*c* defines a hole 71 having a circular section in cooperation with a holding cap 70 connected to an upper end portion of the bearing cap 23*b* with a bolt, so that a support shaft 31*a* formed on the fulcrum portion 31 is inserted into the hole 71 in such a manner as to slide therein. Then, a support shaft 31*a* of a holder 30 belonging to the adjacent cylinder 1 is supported on the common bearing cap 23*b*.

Referring to FIG. 2, in a lower side portion of each side wall 43 which constitutes a lower side portion of the base portion 41, a portion on the camshaft 20 side where the projecting wall 45 projects downwardly from the side wall 43 forms an accommodating portion 39 which defines an accommodating space 39*a* for accommodating therein the holder 30 and the rocker shaft 24 which is a member disposed on the periphery of the primary rocker arm 50 in cooperation with a portion of the projecting wall 45 which is closer to the side wall 43. The accommodating space 39*a* opens downwardly toward the rocker shaft 24. Then, a ratio at which the rocker shaft 24 is accommodated in the accommodating space 39 becomes maximum when the rocker shaft 24 occupies a primary limit position as a predetermined position which is an oscillation position resulting when the holder 30 oscillates most downwardly (a state shown in FIG. 2 or FIG. 6).

Referring to FIG. 3, as well, in the base portion 41, a portion excluding the fulcrum portion 31 is disposed between the pair of exhaust rocker arms 25 in the rotational center line direction A3, and the primary and secondary rocker arms 50, 60 are disposed between the pair of side walls 43 in the rotational center line direction A3. The primary support portion 33 and the primary oscillating center line L4 are situated on the exhaust side, whereas the secondary support portion 34 and the secondary oscillating center line L5 are situated on the inlet side. Then, the distance to the holder oscillating center line L3 gets longer in the order of the secondary oscillating center line L5, the rotational center line L2, the primary oscillating center line L4 and the rotational center line L6. Therefore, as shown in FIG. 2, with a primary intersection point C1 between the orthogonal plane and the primary oscillating center line L4 and a secondary intersection point C2 between the orthogonal plane and the secondary oscillating center line L5, a distance between the holder oscillating center line L3 and the primary intersection point C1 is longer than a distance between the holder oscillating center line L3 and the secondary intersection point C2.

In addition, in the oscillating range of the holder 30, the primary oscillating center line L4 includes the holder oscillating center line L3 and is situated on a camshaft side where the camshaft 20 is situated or a lower side relative to a specific plane H2 which intersects at right angles with the reference plane H1, whereas the secondary oscillating center line L5 is situated on an opposite side to the camshaft side or an upper side. In this embodiment, when the holder 30 occupies a secondary limit position as a predetermined position which is an oscillation position resulting when the holder 30 oscillates most upwardly (a state shown in chain double-dashed lines in FIG. 1, or a state shown in FIG. 7), the primary oscillating center line L4 is situated substantially on the specific plane H2 and is situated below the specific plane H2 when the holder 30 occupies any other position than the secondary limit position.

The primary support portion, which regulates the primary oscillating center line L4, is provided on a lower end portion of the projecting portion 42 which constitutes a location closer to the inlet cam 21 and has a cylindrical support shaft 35 which is press fitted into a hole formed in each side wall 43. The primary rocker arm 50, which is supported by the support shaft 35 at a fulcrum portion 51 in an oscillatory fashion via a multiplicity of needles 36, abuts with the inlet cam 21 at a roller 53 possessed by a cam abutment portion 52 made up of one end portion of the primary rocker arm 50 and abuts with the secondary rocker arm 60 at a drive abutment portion 54 made up of the other end portion thereof. In the primary rocker arm 50, the fulcrum portion 51 is provided at an intermediate portion which is a location between the cam abutment portion 52 and the drive abutment portion 54. Then, the primary rocker arm 50 is biased by virtue of a biasing force of a biasing device (not shown) such as a spring held by the holder 30 such that the roller 53 is pressed against the inlet cam 24 at all times. In addition, an accommodation space 57 for accommodating therein the roller 53 is provided in the primary rocker arm 50 in such a manner as to extend from the fulcrum portion 51 to the cam abutment portion 52, and the accommodation space 57 constitutes an escape space which allows the passage of a cam lobe portion 21*b* of the rotating inlet cam 21. Then, the primary rocker arm 50 and the inlet cam 21 can be disposed close to each other, while the interference of the primary rocker arm 50 with the inlet cam 24 is avoided by the accommodation space 57.

The secondary support portion 34, which regulates the secondary oscillation center line L5, is provided on the base portion 41 so as to be situated between the primary support portion 33 and the holder oscillating center line L3 in the orthogonal direction A2 and has a support shaft 37 which is press fitted into a hole formed in each side wall 43. The secondary rocker arm 60, which is supported by the support shaft 37 at a fulcrum portion 61 in an oscillatory fashion via a multiplicity of needles 38, abuts with the drive abutment portion 54 of the primary rocker arm 50 at a roller 63 possessed by a follower abutment portion 62 made up of one end portion of the secondary rocker arm 60 and abuts with the valve stems 14*a* as the abutment portions of the pair of inlet valves 14, respectively, at adjustment screws 65 possessed by a pair of valve abutment portions 64 made up of the other end portion thereof. Here, in the secondary rocker arm 60, the valve abutment portion 64 is a location which is situated closer to the inlet valve 14 and is also a location which is situated on an extension of the valve spring 13 in a direction (a direction parallel to the axis L7) in which the valve spring 13 extends and contracts. Then, in the secondary rocker arm 60, the fulcrum portion 61 is provided on an intermediate portion which is a location between the follower abutment portion 62 and the valve abutment portion 64. In addition, since the sectional shape of the roller 63 is of a circular shape, the sectional shape of an abutment surface of the follower abutment portion 62, which is brought into abutment with a cum profile 55, which will be described later, is of an arc-like shape, as well.

On the drive abutment portion 54 acting as one of the drive abutment portion 54 and the follower abutment portion 62 which are brought into abutment with each other, the cam profile 55 is formed, which cam profile 55 has a lost motion profile 55*a* which maintains the inlet valve 14 in a closed state and a drive profile 55*b* which puts the inlet valve 14 in an opened state through the abutment with the roller 63 of the follower abutment portion 62 which acts as the other abutment portion. Then, an arm abutment position P2, which is an abutment position where the cam profile 55 and the roller 63 abut with each other, resides above the camshaft 20 and the rocker shaft 24 and is situated at a position which is superposed above the camshaft 20 and the rocker shaft when viewed from the cylinder axis direction A1 (hereinafter, referred to as when viewed from the top).

The lost motion profile 55*a* is formed so as to have an arc-like sectional shape which is formed about the primary oscillating center line L4 and is designed such that the valve drive force F1 of the inlet cam 21 which is transmitted via the primary rocker arm 50 is not transmitted to the secondary rocker arm 60 in a state in which a clearance is formed between the lost motion profile 55*a* and the roller 63, as well as in a state in which the roller 63 is in abutment with the lost motion profile 55*a*. As this occurs, the primary rocker arm 50 is in a rest state where the secondary rocker arm 60 is not oscillated by the inlet cam 21 via the primary rocker arm 50. Then, when the primary rocker arm 50 and the secondary rocker arm 60 are brought into abutment with each other in a state where the roller 53 of the primary rocker arm 50 is in abutment with a base circle portion 21*a* of the inlet cam 21, the roller 63 abuts with the lost motion profile 55*a* at all times. Consequently, when the arm abutment position P2 is located at an arbitrary position on the lost motion profile 55*a*, the inlet valve 14 is maintained in the closed state by virtue of the spring force of the valve spring 13, and a valve clearance is formed between a valve abutment surface 65*a* of the adjustment screw 65 which acts as a valve abutment surface of the valve abutment portion 64 and a distal end surface 14*b* of the valve stem 14*a* which acts as an abutment surface of the inlet valve 14.

The drive profile 55*b* transmits the valve drive force F1 of the inlet cam 21 which is transmitted thereto via the primary rocker arm 50 to the secondary rocker arm 60 so as to oscillate the secondary rocker arm 60, and when the adjustment screw 65 is in abutment with the valve stem 14*a*, the secondary rocker arm 60 which is oscillating transmits the valve drive force F1 to the inlet valve 14 to thereby put the inlet valve 14 into an opened state with a predetermined lift amount being provided.

Consequently, the oscillating position of the secondary rocker arm 60 relative to the holder 30 is regulated by the primary rocker arm 50.

In addition, the drive abutment portion 54 has a pent roof-like thin portion 54*a* which projects diagonally downwardly toward the inlet cam 24 or the inlet valve 14, and the lost motion profile 55*a* is formed on the thin portion 54*a*. Then, an accommodation portion 56 in which the rocker shaft 24 is accommodated in accordance with the oscillating position thereof is formed by making use of the thin portion 54*a* in the primary rocker arm 50 between the primary oscillating center line L4 and the lost motion profile 55*a* in a radial direction which radiates from the primary oscillating center line L4 as a center. Then, as the holder 30 approaches the primary limit position and the primary rocker arm 50 oscillates in a direction in which the lift amount of the inlet valve 14 is increased, the ratio at which the rocker shaft 24 is accommodated in the accommodation portion 56 is increased.

The sectional shape of the valve abutment surface 65*a* of the adjustment screw 65 which abuts with the distal end surface 14*b* of the inlet valve 14 is an arc that is formed about the holder oscillating center line L3 when in a state where the cam profile 55 of the primary rocker arm 50 and the roller 63 of the secondary rocker arm 60 are in abutment with each other and a state where the secondary rocker 60 is in the rest state, that is, a state where the roller 63 abuts with the lost motion profile 55*a*. Due to this, the valve abutment surface 65*a* is made up of a partially cylindrical surface which is part of a cylindrical surface that is formed about the holder oscillating center line L3 or a partially spherical surface which is part of a spherical surface that is formed about a point on the holder oscillating center line 3 when in a state the secondary rocker arm 60, which is in the rest state, abuts with the lost motion profile 55*a*. Then, the secondary rocker arm 60, when in the rest state, does not oscillate relative to the holder 30 irrespective of the oscillating position of the holder 30 in the state where the roller 63 of the secondary rocker arm 60 does not abut with the lost motion profile 55*a* of the primary rocker arm 50.

The pair of fulcrum portions 31 on the base portion constitutes an accommodation space in which the pair of valve abutment portions 64 provided in series in the rotational center line direction A3 and the pair of adjustment screws 65 are accommodated.

Furthermore, when the primary rocker arm 60 is in the rest state so as to maintain the inlet valve 14 in the closed state, the fulcrum portion 31 is situated at a position where the fulcrum portion 31 is superposed on the valve abutment portion 64 and the adjustment screw 65 when viewed sideways, and the holder oscillating center line L3 is situated at a position where the holder oscillating center line L3 intersects at right angles with the valve abutment portion 64 and, furthermore, the adjustment screw 65, and more precisely, the holder oscillating center line L3 is situated at a position where it intersects at right angles with the center axis of the adjustment screw 65.

In addition, the primary rocker arm 50 is disposed in such a manner as to extend long in the cylinder axis direction A1 and is situated on the exhaust side except for the drive abutment portion 54 within the oscillating range of the holder, the cam abutment position P1 which is the abutment position where the roller 53 abuts with the inlet cam 21 is situated on the exhaust side, and the arm abutment position P2 is situated on the inlet side. Then, the roller 53 abuts with the inlet cam 21 at a portion which is closer to the exhaust valve 15 in the orthogonal direction A2, and when the holder 30 oscillates, the cam abutment position P1 shifts mainly in the cylinder axis direction A1. On the other hand, the secondary rocker arm 60 is disposed in such a manner as to extend long in the orthogonal direction A2 and along the base portion 41 and is situated at on the inlet side within the oscillating range of the holder 30.

Referring to FIG. 4, as well, the drive shaft 29 is a single rotating shaft which is common to all the cylinders 1 in the orthogonal direction A2 and is rotatably supported on the bearing caps 23*b* at journal portions 29*a* thereof by means of holding caps 72 which are connected to the bearing caps 23*a* with bolts to thereby be rotatably supported on the cylinder head 3. Drive gears 29*b* are provided on the drive shaft 29 at certain intervals in the rotational center line direction A3 for each cylinder 1, and the drive gear 29*b* meshes with the gear portion 32 formed in the connecting wall 44 so as to oscillate the holder 30 about the holder oscillating center line L3 by virtue of the torque of the electric motor 28.

The gear portion 32 is a surface on the connecting wall 44 constituting part of the base portion 41 and the projecting portion 42 which surface faces the drive shaft 29 and is formed to extend between the base portion 41 and the projecting portion 42 on an outer circumferential surface 44*c* in a radial direction which radiates from the holder oscillating center line L3 as a center. This outer circumferential surface 44*c* constitutes a location of the holder 30 which is farthest apart from the holder oscillating center line L3. The gear portion 32 is formed such that the shape thereof on the orthogonal plane becomes an arc-like shape which is formed about the holder oscillating center line L3 and has a number of teeth which are arranged in an arc-like fashion on the orthogonal plane. Then, a line of action of a drive force exerted from the drive shaft 29 so as to act on the gear portion 32 is directed in a tangential direction to an arc that is formed about the holder oscillating center line L3 on the orthogonal plane.

In addition, the drive shaft 29 is situated on an extension of a valve stem 15*a* of the exhaust valve 15 which extends along an axis L8 of the valve stem 15*a*, and most of the whole of drive shaft 29 is situated closer to the reference plane Hi than the extension of the valve stem 15*a*. In addition, in the orthogonal direction A2, the drive shaft 29 is situated substantially at the same position as those of the valve abutment portion 25*b* of the exhaust rocker arm and a distal end face 15*b* of the valve stem 15*a*. Due to this, as shown in FIG. 4, when viewed from the top, the drive shaft 29 is situated at a position which is superposed above the valve abutment portion 25*b* and the distal end face 15*b*. Here, in the exhaust valve 15, the valve stem 15*a* is an abutment portion with which the valve abutment portion 25 is brought into abutment, and the distal end face 15*b* is an abutment surface of the abutment portion.

The electric motor 28 is controlled by an electronic control unit (hereinafter, referred to as ECU) into which detection signals from operating conditions detecting units for detecting operating conditions of the internal combustion engine E are inputted. The operating conditions detecting units include a rotational speed detecting unit for detecting the engine rotational speed of the internal combustion engine E, a load detecting unit for detecting the load of the internal combustion engine E and the like. Then, by controlling the rotational direction and rotational speed of the electric motor 28 according to the operating conditions by the ECU, the rotational direction and rotational amount of the drive shaft 29 are controlled, whereby the holder 30 is driven to oscillate within the oscillating range which is regulated between the primary limit position and the secondary limit position by the electric motor 28, irrespective of the rotational position of the inlet cam 21 or the camshaft 20. Then, the primary rocker arm 50 having the primary center line L4 which oscillates together with the holder 30 and the secondary rocker arm 60 having the secondary oscillating center line L5 shift, respectively, in accordance with the oscillating position of the holder that is controlled in accordance with the operating conditions, whereby the opening and closing timings, maximum lift amount and maximum lift timing are changed continuously.

In addition, as shown in FIG. 3, the holder 30, the primary and secondary rocker arms 50, 60 and the drive gear 29*b* are formed so as to be substantially symmetrical with respect to plane relative to a plane H3 which contains a central point which bisects the width of the primary rocker arm 50 in the rotational center line direction A3 and intersects at right angles with the holder oscillating center line L3. Consequently, since in the transmission mechanism Mi, there is generated no moment acting around a straight line which intersects at right angles with the reference plane H1 based on the valve drive force F1, the reaction force F2 from the inlet valve 14 and the drive force of the drive shaft 29, an increase in abutment pressure that is generated locally at a sliding portion by the moment is prevented, thereby the durability of the transmission mechanism Mi being increased.

Next, referring to FIGS. 5 to 8, the valve operating properties will be described below that can be obtained by the inlet operation mechanism.

Figure 5:
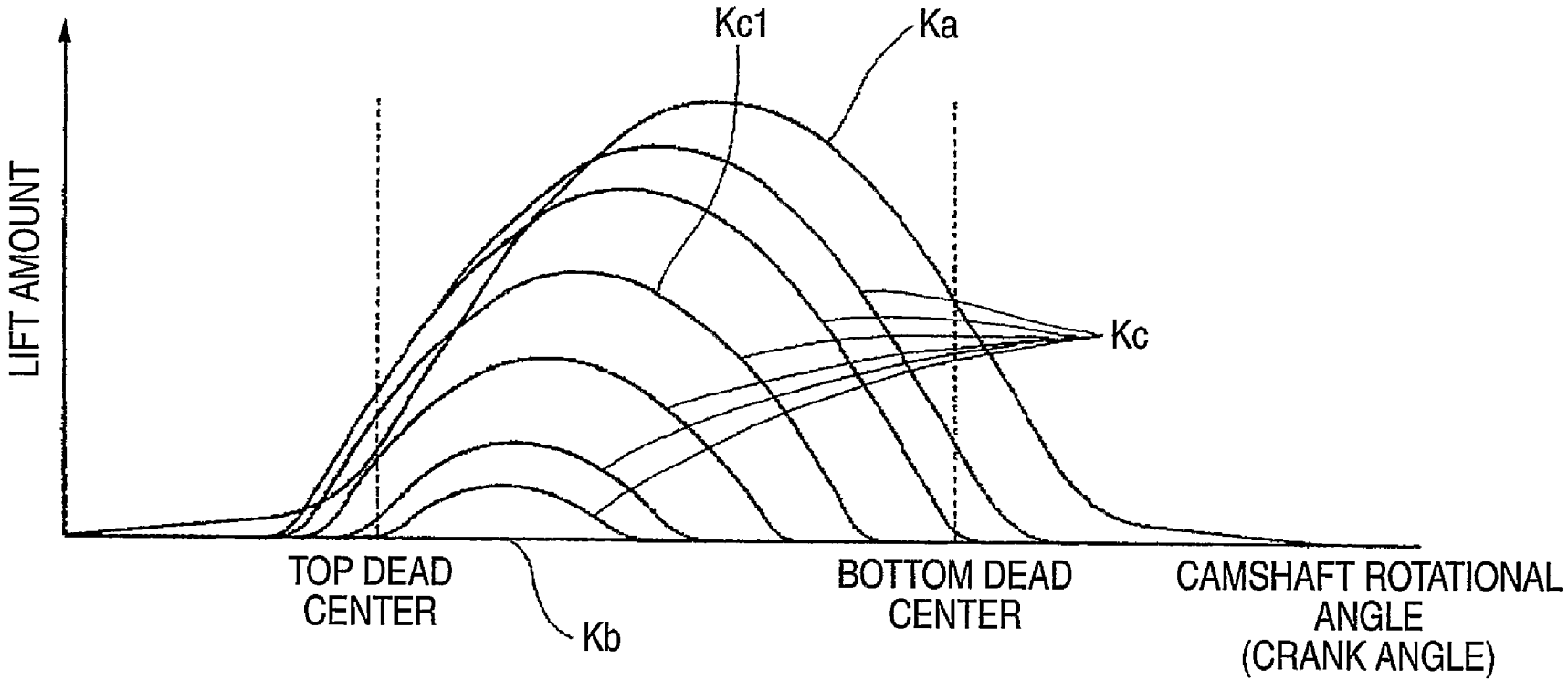
FIG. 5 is a graph showing valve operating properties of the valve train shown in FIG. 1.

Referring to FIG. 5, the valve operating properties are changed between a maximum valve operating property Ka and a minimum valve operating property Kb continuously with the maximum valve operating property Ka and the minimum valve operating property Kb acting as limit properties, whereby a countless number of intermediate valve operating properties Kc ban be obtained between both the valve operating properties Ka, Kb. For example, the opening and closing timings and maximum valve lift amount of the inlet valve 14 changes as will be described below from the maximum valve operating property Ka which is a valve operating property resulting when the internal combustion engine E is operated in a high rotational speed region or high load region to the minimum valve operating property Kb via the intermediate valve operating properties Kc which are valve operating properties resulting when the internal combustion engine E is operated in a low rotational speed region or low load region via. The valve opening timing is delayed continuously, whereas the valve closing timing is advanced continuously in a large changing amount when compared with the opening timing so that the valve opening period becomes short continuously, and furthermore, the maximum lift timing where the maximum lift amount can be obtained is advanced continuously, and the maximum lift amount becomes small continuously. Note that the maximum lift timing is introduced to a timing which bisects the valve timing period.

In addition, in this embodiment, the minimum valve operating property is a valve operating property where a valve rest state can be obtained where the maximum lift amount becomes zero and the opening and closing operation of the inlet valve 14 comes to rest.

Figure 6:
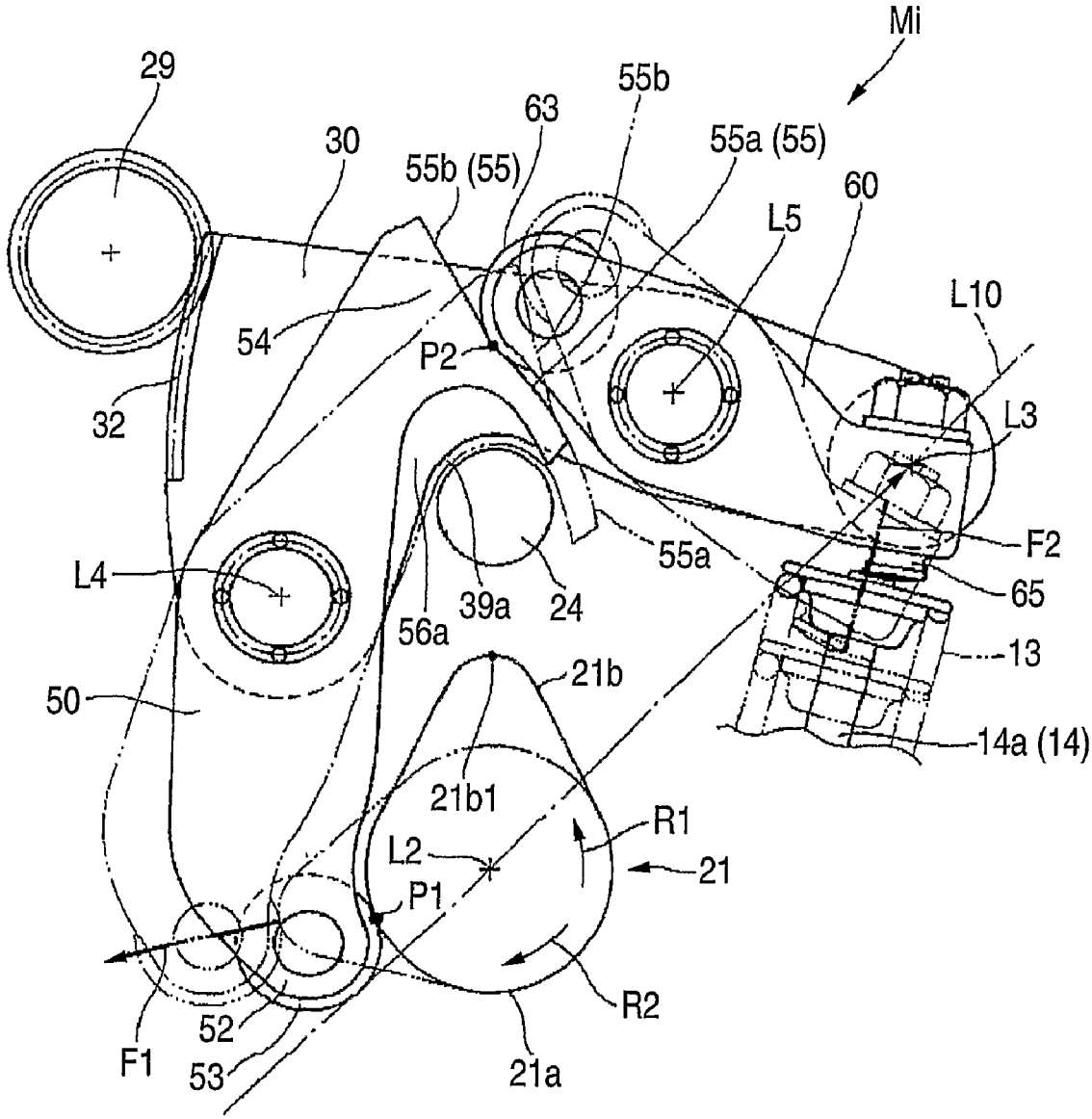
FIG. 6 is a drawing explaining the operation of an inlet operation mechanism when a maximum valve operating property of the valve train shown in FIG. 1 is obtained.

In the valve operating properties that can be obtained by the inlet operation mechanism, in the maximum valve operating property Ka, the valve opening period and the maximum lift amount become maximum, and the valve closing timing is introduced to a timing where it is most delayed. The maximum valve operating property Ka can be obtained when the holder 30 occupies the primary limit position as shown in FIGS. 2, 6. Note that in FIGS. 6 to 8, the transmission mechanism Mi is shown in solid lines which results when the inlet valve 14 is in the closed state, whereas the transmission mechanism Mi is shown in chain double-dashed lines which results when the inlet valve 14 is opened in the maximum lift amount.

Referring to FIG. 6, when situated at the primary limit position, the holder 30 occupies an oscillating position which is closest to the rotational center line L2 or the inlet cam 21 within the oscillating range, and the primary support portion 33 is situated so as to be superposed above the cam lobe portion 21*b* of the inlet cam 21 in the cylinder axis direction A1. The roller 63 of the secondary rocker arm 60 is in a state where the roller 63 abuts with the lost motion profile 55*a* of the cam profile 55 in a state where the roller 53 of the primary rocker arm 50 abuts with the base circle portion 21*a* of the inlet cam 21. As this occurs, the rocker shaft 24 is accommodated in the accommodation space 56*a* at a relatively small ratio. When the primary rocker arm 50 is brought into abutment with the cam lobe portion 21*b* to thereby be caused to oscillate in a counter-rotational direction R2 (a direction opposite to the rotational direction R1 of the inlet cam 21) by virtue of the valve drive force F1, the drive profile 55*b* abuts with the roller 63, so that the secondary rocker arm 60 is caused to oscillate in the counter-rotational direction R2, whereby the secondary rocker arm 60 opens the inlet valve 14 against the spring force of the valve spring 13. Then, the rocker shaft 24 is accommodated in the accommodation space 56*a* at a maximum ratio.

Figure 7:
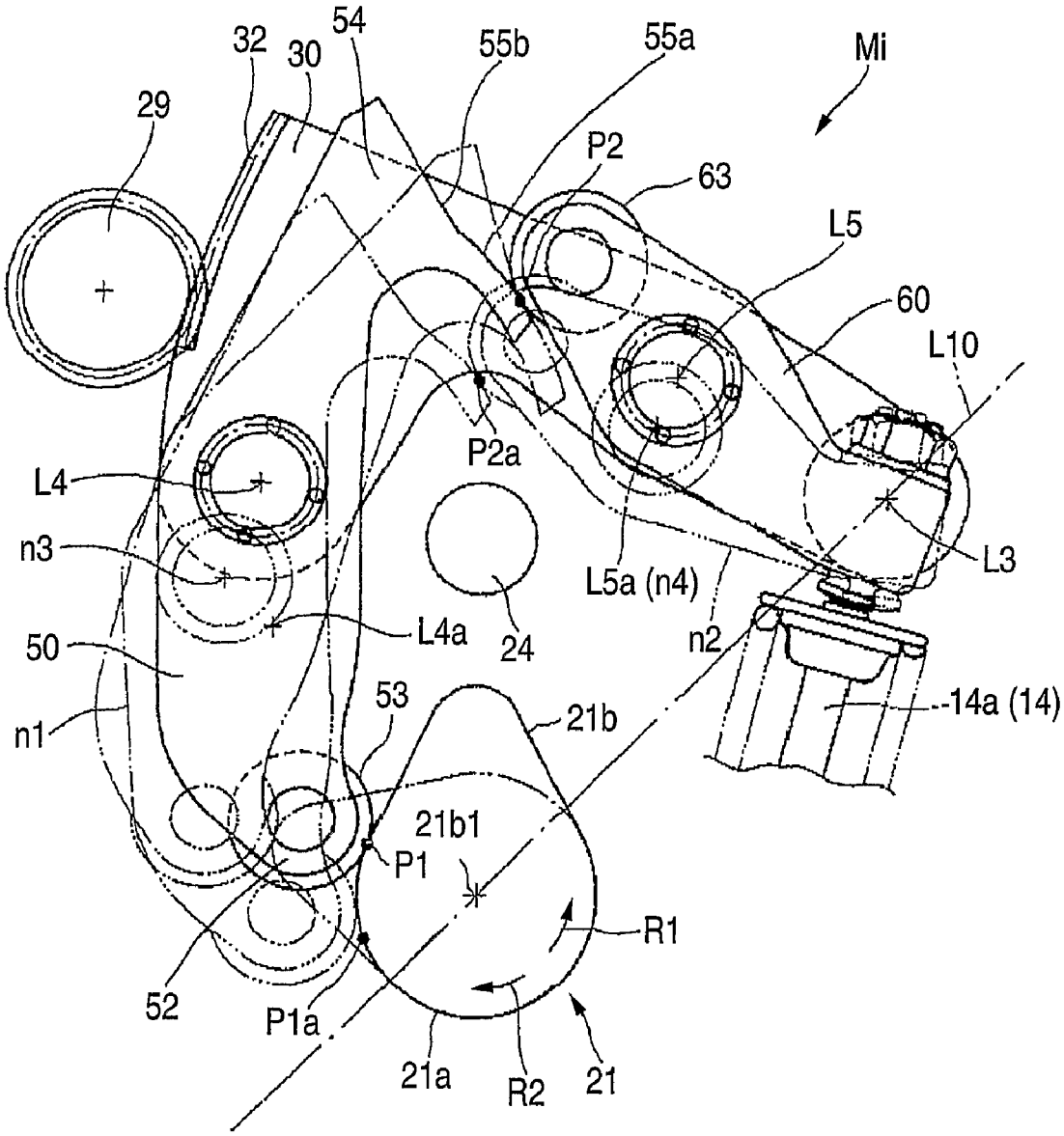
FIG. 7 is a drawing explaining the operation of the inlet operation mechanism when a minimum valve operating property of the valve train shown in FIG. 1 is obtained.

On the other hand, the minimum valve operating property Kb can be obtained when the holder 30 occupies the secondary limit position as shown in FIG. 7. In the minimum valve operating property Kb, irrespective of the fact that the primary rocker arm 50 is caused to oscillate by virtue of the valve drive force F of the inlet cam 21, the roller 63 is in the state where the roller 63 abuts with the lost motion profile 55*a*, and the secondary rocker arm 60 is in the rest stage. The holder 30, which is situated at the secondary limit position, occupies a farthest oscillating position from the rotational center line L2 or the inlet cam 21 within the oscillating range.

Figure 8:
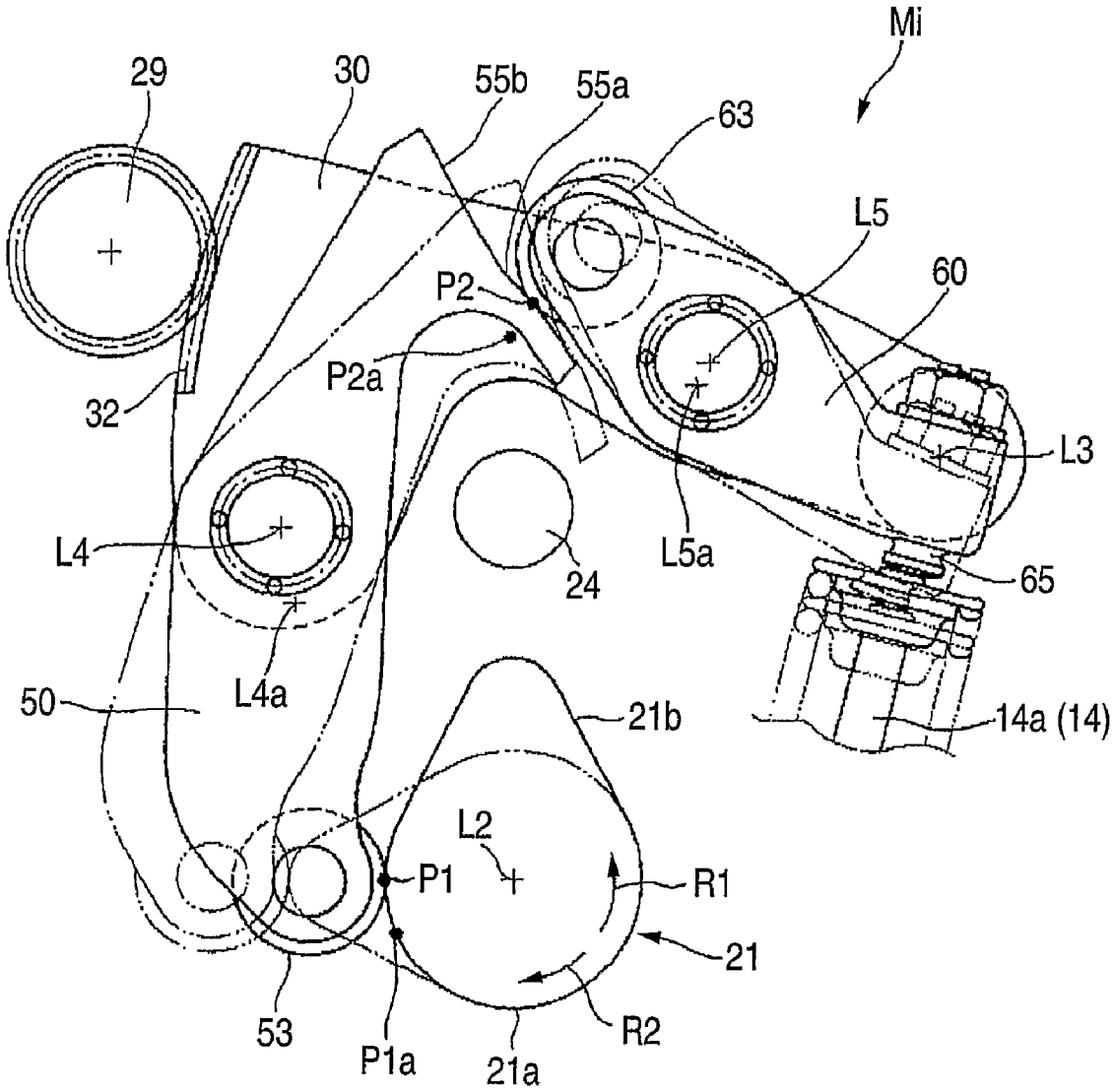
FIG. 8 is a drawing explaining the operation of the inlet operation mechanism when an intermediate valve operating property of the valve train shown in FIG. 1 is obtained.

In addition, when the holder 30 occupies a central position which is substantially the center of the oscillating range, as shown in FIG. 8, as an oscillating position between the primary limit position and the secondary limit position, an intermediate valve operating property Kc1 can be obtained as one of a countless number of intermediate valve operating properties Kc between the maximum valve operating property Ka and the minimum valve operating property Kb, as shown in FIG. 5. In the intermediate valve operating properties Kc, when compared with the maximum valve operating property Ka, the valve opening period and maximum lift amount become small, and the opening timing is introduced to a timing where it is delayed, whereas the closing timing and the maximum lift timing are introduced to a timing where they are advanced.

Thus, in the valve train V, as the maximum lift amount becomes smaller, while the opening timing is delayed in a relatively small changing amount, the closing timing and the maximum lift timing are advanced in a relative large changing amount when compared with the opening timing, whereby the inlet valve 14 is closed earlier. Due to this, when the internal combustion engine E is operated in the low rotational speed region or low load region, the inlet valve 14 is operated to be opened and closed in a small lift amount region where the maximum lift amount is small, and the valve operating properties are controlled so that the closing timing of the inlet valve 14 is advanced, whereby a pumping loss is reduced to thereby increase the fuel consumption performance by implementing an earlier closing of the inlet valve 14.

Next, referring to FIGS. 5, 6, 7, the operation of the transmission mechanism Mi will be described below which results when the holder 30 oscillates from the primary limit position to the secondary limit position.

When the drive force of the drive shaft 29 driven by the electric motor 28 acts on the gear portion 32, whereby the holder 30 oscillates upwardly from the primary limit position in an oscillating direction (in the counter-rotational direction R2) in which the holder 30 moves apart from the rotational center line L2, the cam abutment position P1 shifts in the counter-rotational direction R2, and at the same time the primary and secondary oscillating center lines L4, L5 oscillate together with the holder 30 so that the arm abutment position P2 shifts in a direction in which the maximum lift amount of the inlet valve 14 is decreased and in a direction to move apart from the rotational center line L2, whereby the primary and secondary rocker arms 50, 60 oscillate around the primary and secondary oscillating center lines L4, L5, respectively. In FIG. 7, L4*a*, L5*a*, P1*a* and P2*a* denote, respectively, primary and secondary oscillating center lines, a cam abutment position and an arm abutment position when the holder occupies the primary limit position.

When the primary oscillating center line L4 oscillates, the cam abutment position P1 shifts in the counter-rotational direction R2, and the timing when the roller 53 is brought into abutment with the cam lobe portion 21*b* is advanced, while the drive abutment portion 54 shifts in a direction in which a shift range of the arm abutment position P2 on the lost motion profile 55*a* (a range of the rotational angle of the camshaft 20 or a range of the crank angle of the crankshaft) is increased in a state where the roller 53 is in abutment with the base circle portion 21*a*. Then, even in the event that the shift range of the arm abutment position P2 on the lost motion profile 55*a* is expanded, so that the arm abutment position R2 is brought into abutment with the cam lobe portion 21*b*, whereby the primary rocker arm 50 starts to oscillate, since the roller 63 stays on the lost motion profile 55*a*, the secondary rocker arm 60 is in the rest state, and when the inlet cam 21 rotates further so that the primary rocker arm 50 is caused to oscillate more largely, whereby the roller 63 is brought into abutment with the drive profile 55*b*, the secondary rocker arm 60 oscillates largely, whereby the inlet valve 14 is opened. Due to this, even with the roller 63 being in abutment with an apex 21*b* of the cam lobe portion 21, the oscillating amount of the secondary rocker arm 60 that is caused to oscillate by the drive profile 55*b* is reduced when compared with when at the primary limit position, whereby the maximum lift amount of the inlet valve 14 is reduced. Then, in this embodiment, the shape of the inlet cam 21, the shape of the cam profile 55, and the positions of the primary and secondary oscillating center lines L4, L5 are set such that when the holder oscillates from the primary limit position toward the secondary limit position, while the opening timing of the inlet valve 14 is, as shown in FIG. 5, delayed in a relatively small changing amount, the closing timing and maximum lift amount of the inlet valve 14 are advanced in a larger changing amount than the changing amount of the opening timing.

In addition, the valve operating properties are controlled such that when the holder 30 oscillates from the secondary limit position toward the primary limit position in such a manner as to approach the rotational center line L2, the opening timing of the inlet valve 14 advances continuously from the minimum valve operating property Kb to the maximum valve operating property Ka, whereas the closing timing is delayed continuously, so that the valve opening period is extended continuously, and furthermore, the maximum lift amount timing is delayed continuously and the maximum lift amount is increased continuously.

In addition, as is clear from FIGS. 6, 7, since, when the oscillating position of the holder 30 is situated at the primary limit position where the maximum valve operating property Ka can be obtained where the maximum lift amount becomes maximum, the cam abutment position P1 where the roller 53 of the cam abutment portion 52 abuts with the cam lobe portion 21*b* of the inlet cam 21 is situated at a position close to a specific straight line L10 which passes through the holder oscillating center line L3 and the rotational center line L2 on the orthogonal plane which intersects at right angles with the holder oscillating center line L3 when compared with when the holder 30 occupies the secondary limit position where the minimum valve operating property Kb can be obtained where the maximum lift amount becomes smallest, as the holder 30 approaches the primary limit position where the valve drive force is increased, the cam abutment position P1 where the roller 53 abuts with the cam lobe portion 21*b* approaches the specific straight line L10 on the orthogonal plane.

Next, referring to FIG. 7, the operation of the primary and secondary rocker arms 50, 60 will be described below which results when the holder 30 oscillates within the oscillating range.

Since the primary and secondary rocker arms 50, 60 shift in accordance with the oscillating positions of the primary and secondary oscillating center lines L4, L5 which oscillate together with the holder, the relative position of the primary and secondary oscillating center lines L4, L5 on the holder 30 remains unchanged, and moreover, since the sectional shape of the lost motion profile 55*a* is the arc-like shape which is formed about the primary oscillating center line L4, the positional relationship among the three members such as the primary and secondary oscillating center lines L4, L5 and the arm abutment position P2 remains unchanged irrespective of the oscillating position of the holder 30 when the lost motion profile 55*a* and the roller 63 are in the abutment state where the two members abut with each other.

In addition, since the primary and secondary oscillating center lines L4, L5 oscillate together with the holder 30, the control range of the valve operating properties can be set large by increasing the shift amount of the cam abutment position P1. For example, in order to obtain the same abutment position as the arm abutment position relative to the lost motion profile 55*a*, as with primary and secondary rocker arms n1, n2 shown in chain triple-dashed lines in FIG. 7, a primary oscillating center line N3 shifts, and when compared with a case where while a primary oscillating center line n3 shifts, a secondary oscillating center line n4 does not shift, in this transmission mechanism Mi, the shift amount of the cam abutment position P1 can be increased. As a result, when compared with the conventional example, the opening and closing timings of the inlet valve 14 can be changed in a large oscillating amount. Then, even in the event that the holder oscillates in a large oscillating amount so that the control range of the valve operating properties is set large, the relative shift amount of the arm abutment position P2 with the roller on the cam profile 55*a* can be suppressed to a small level.

Next, the function and advantage of the embodiment constructed as has been described heretofore will be described below.

The transmission mechanism Mi includes the primary and secondary rocker arms 50, 60 which have, respectively, the drive abutment portion 54 and the follower abutment portion 62 which abut with each other and the holder 30 which is caused to oscillate around the holder oscillating center line L3 by the electric motor 28 and which support the primary and secondary rocker arms 50, 60 in an oscillatory fashion so that the primary and secondary oscillating center lines L4, L5 oscillate together. The cam profile 55 having the lost motion profile 55*a* and the drive profile 55*b* is formed on the drive abutment portion 54, and since the sectional shape of the lost motion profile 55*a* on the orthogonal plane which intersects at right angles with the primary oscillating center line L4 is the arc-like shape which is formed about the primary oscillating center line L4, the relative position of the primary and secondary oscillating center lines L4, L5 in the holder 30 remains unchanged, when the valve operating properties are changed through the shift of the primary and secondary rocker arms 50, 60 in accordance with the oscillating positions of the primary and secondary oscillating center lines L4, L5 which rotate together with the holder 30. Moreover, since the sectional shape of the lost motion profile 55*a* is the arc-like shape which is formed about the primary oscillating center line L4, it becomes easy to maintain the clearance formed between the lost motion profile 55*a* and the roller 63 or the abutment state between the lost motion profile 55*a* and the roller 63, thereby making it possible to maintain an appropriate valve clearance even at the time of changing the valve operating properties. Due to this, the increase in noise can be prevented which would otherwise result, for example, from the valve striking noise by virtue of an increase in valve clearance and collision of both the rocker arms 50, 60 with each other. In addition, even in the event that the holder 30, which supports the primary and secondary rocker arms 50, 60, oscillates in a large oscillating amount in order to increase the control range of the valve operating properties, since the primary and secondary oscillating center lines L4, L5 oscillate together with the holder 30, when compared with the case where while one of the primary and secondary oscillating center lines shifts, the other does not, the relative shift amount of the arm abutment position P2 can be suppressed to a small level, and therefore, also in this case, it becomes easy to maintain the clearance between the cam profile 55*a* and the roller 63 or the abutment state therebetween, thereby making it possible to set large the control range of the valve operating properties.

The secondary rocker arm 60 has the valve abutment portion 64 which has, in turn, the valve abutment surface 65*a* which is brought into abutment with the inlet valve 14, and the distance between the primary oscillating center line L4 and the holder oscillating center line L3 is longer than the distance between the secondary oscillating center line L5 and the holder oscillating center line L3, whereby since the valve drive force F1 of the inlet cam 21 is transmitted to the inlet valve 14 only through the primary and secondary rocker arms 50, 60, the transmission mechanism Mi is made compact in size, and hence the valve train V itself is made compact in size. Due to this, the cylinder head 3 on which the valve train V is provided becomes compact in size. In addition, when the holder 3 oscillates, since the shift amount of the primary oscillating center line L4 becomes larger than that of the secondary oscillating center line L5, the shift amount of the cam abutment position P1 can be increased, and therefore, the control range of the opening closing timings of the inlet valve 14 can be set large. Moreover, since the shift amount of the valve abutment position which is the abutment position where the valve abutment portion 64 of the secondary rocker arm 60 abuts with the inlet valve 14 can be reduced, the wear of the valve abutment portion 64 can be suppressed, thereby making it possible to extend a period of time when the proper valve clearance is maintained.

In the holder 30 having the base portion 41 which extends from the holder oscillating center line L3 toward the gear portion 32 substantially in the orthogonal direction A2 and the projecting portion 42 which projects from the base portion 41 in the direction to approach the inlet cam 21 substantially in the cylinder axis direction A1, the primary support portion 33 is provided on the projecting portion 42 for supporting the primary rocker arm 50 in an oscillatory fashion, and the secondary support portion 34 is provided on the base portion 41 for supporting the secondary rocker arm 60 in an oscillatory fashion. Since the primary and secondary support portions 33, 34 are disposed between the holder oscillating center line L3 and the gear portion 32, the gear portion 32 is situated farther than the primary and secondary support portions 33, 34 relative to the holder oscillating center line L3, and therefore, the drive force of the electric motor 28 can be reduced, whereby the electric motor 28 is made compact in size. Moreover, since the primary support portion 33 and the secondary support portion 34 are provided on the projecting portion and the base portion separately, the space between the holder oscillating center line L3 and the gear portion 32 can be reduced, whereby the holder 30 is made compact in size between the holder oscillating center line L3 and the gear portion 32. Due to this, the cylinder head 3 on which the valve train V is provided can be made compact in size in the orthogonal direction A2. In addition, since the primary support portion 33 which is provided on the projecting portion 41 is situated closer to the inlet cam 21 than to the base portion 41, in the primary rocker arm 50, when compared with a case where the primary support portion is provided on the base portion 41, the distance between the primary oscillating center line L4 and the cam abutment portion 52 becomes short, a required rigidity against the valve drive force F1 is ensured, while the primary rocker arm 50 is made light in weight.

The accommodation space 39*a* for accommodating the rocker shaft 24 which supports the exhaust rocker arm 25 is formed in the holder 30, whereby the holder 30 and the rocker shaft 24 can be disposed close to each other, while the interference of the holder 30 with the rocker shaft 24 is avoided, and therefore, the valve train V is made compact in size, and moreover, the oscillating range of the holder 30 can be increased within the limited space, and therefore, the control range of the valve operating properties can be increased.

In the primary rocker arm 50, the accommodation space 56*a* for accommodating the rocker shaft 24 which supports the exhaust rocker arm 25 in an oscillatory fashion is formed between the primary oscillating center line L4 and the lost motion profile 55*a* in the radial direction which radiates from the primary oscillating center line L4 as a center, whereby almost no valve drive force F1 or reaction force F2 from the inlet valve 14 is transmitted to the lost motion profile 55*a*, and therefore, the rigidity required for the portion of the drive abutment portion 54 where the lost motion profile 55*a* is formed only has to be small, and the portion can be made thin, and therefore, the primary rocker arm 50 is made light in weight. In addition, the accommodation space 56*a* is formed by making used of the thin portion 54*a*. Then, since, by allowing the rocker shaft 24 to be accommodated in the accommodation space 56*a*, the primary rocker arm 50 and the rocker shaft 24 can be disposed close to each other, while the interference of the primary rocker arm 50 with the rocker shaft 24 is avoided, the valve train V is made compact in size. Furthermore, by allowing the rocker shaft to also be accommodated in the accommodation space 39*a*, the primary rocker arm 50 and the rocker shaft 24 can be disposed close to each other, while the interference of the primary rocker arm 50 with the rocker shaft 24 is avoided, and therefore, the valve train V is made compact in size. In addition, since the oscillating range of the holder 30 which supports the primary rocker arm 50 within the space in the limited valve chamber 16 can be increased the control range of the valve operating properties can be set large.

Due to the primary rocker arm 50 which is in abutment with the inlet cam 24 and the secondary rocker arm 60 being in the state where the primary rocker arm 50 and the secondary rocker arm 60 are in abutment with each other at the abutment portions 54, 63, respectively, the sectional shape of the valve abutment surface 65*a* of the valve abutment portion 64 provided on the secondary rocker arm 60 having the secondary oscillating center line L5 which oscillates together with the holder 30 on the orthogonal plane which intersects at right angles with the holder oscillating center line L3 is the arc-like shape which is formed about the holder oscillating center line L3 in the state where there exists no clearance in the transmission path of the valve drive force which extends from the inlet cam 21 to the secondary rocker arm 60 via the primary rocker arm 50, and with the secondary rocker arm 60 being in the rest state where the secondary rocker arm 60 is not caused to oscillate by the inlet cam 21 via the primary rocker arm 50, and therefore, even in the event that the holder 30 oscillates about the holder oscillating center line L3 in order to change the valve operating properties, the secondary rocker arm 60 having the secondary oscillating center line L5 which oscillates together with the holder 30 oscillates together with the holder 30, and the clearance between the valve abutment surface 65*a* and the distal end face 14*b* of the inlet valve 14 is maintained constant, whereby the valve clearance from the inlet cam 21 to the inlet valve 14 is maintained constant.

The valve abutment portion 64 having the valve abutment surface 65*a* which is brought into abutment with the distal end face 14*b* of the inlet valve 14 is provided on the secondary rocker arm 60 at the position which intersects at right angles with the holder oscillating center line L3, whereby the valve abutment surface 65*a* is allowed to be close to the holder oscillating center line L3, and therefore, even in the event that the secondary oscillating center line L5 oscillates due to the oscillation of the holder 30, whereby the valve abutment position where valve abutment surface 65*a* abuts with the distal end face 14*b* is caused to shift, the shift amount is made to be small, and in this respect, as well, the progress in wear of the valve abutment surface 35*a* attributed to the oscillation of the holder 30 is suppressed, and then, the period of time when the appropriate valve clearance is maintained is extended. In addition, the valve abutment surface 65*a* resides close to the holder oscillating center line L3, whereby the valve abutment portion 64 can be reduced, and therefore, the secondary rocker arm 60 is made small in size.

The gear portion 32 on which the drive force of the drive shaft 29 acts is provided on the holder 30 on the outer circumference 44*c* which is the location of the holder 30 which is farthest apart from the holder oscillating center line L3 on the orthogonal plane, whereby on the holder 30, the distance from the holder oscillating center line L3 to the acting position of the drive force can be made substantially maximum, and therefore, the drive force of the electric motor 28 can be reduced, the electric motor 28 being thereby made compact in size. In addition, the gear portion 32 is provided so as to extend from the base portion 41 to the projecting portion 42, whereby the forming range of the gear portion 32 can be increased, and therefore, the oscillating range of the holder 30 can be increased.

When the holder 30 oscillates in the oscillating direction to move away from the rotational center line L2, the cam abutment position P1 shift in the counter-rotational direction R2, and at the same time the arm abutment position P2 shifts in the direction in which the maximum lift amount of the inlet valve 14 is reduced and in the direction to move away from the rotational center line L2, whereby the closing timing and the maximum lift timing are advanced, and at the same time the valve operating property can be obtained where the maximum lift amount is reduced. As this occurs, although the secondary rocker arm 60 shifts together with the holder in the direction to move away from the rotational center line L2, since at the same time the maximum lift amount of the inlet valve 14 which is actuated to be opened and closed by the secondary rocker arm 60 is reduced, the oscillating amount of the secondary rocker arm 60 is reduced, and therefore, the operating space occupied by the secondary rocker arm 60 is made compact by that extent, thereby making it possible to disposed the valve train V in a relatively compact space.

In the event that the abutment state where the inlet cam 21 abuts with the inlet valve 14 can be set by the separate rocker arms due to the primary and secondary rocker arms 50, 60 abutting with the inlet cam 21 and the inlet valve 14, respectively, and since the primary and secondary oscillating center lines L4, L5 oscillate together with the holder 30, even in case the shift amount of the primary rocker arm 50 is increased by virtue of the oscillation of the holder 30 in order to set the control range of the valve operating properties large, when compared with the case where while one of the primary and secondary oscillating center lines shits, the other does not, the relative shift amount of the primary and secondary rocker arms 50, 60 can be suppressed to a small amount. As a result, the degree of freedom in arrangement of the transmission mechanism Mi is increased, and the application range thereof is expanded, and moreover, since the relative shift amount of the primary and secondary rocker arms 50, 60 can be suppressed to a small amount, the control range of the valve operating properties can be set large.

As the oscillating position of the holder 30 approaches the primary limit position where the maximum valve operating property Ka can be obtained, the cam abutment position P1 between the cam abutment portion 52 and the cam lobe portion 21*b* approaches the specific straight line L10 on the orthogonal plane which intersects at right angles with the holder oscillating center line L3, whereby when the cam abutment position P1 is situated on the specific straight line L10, since the line of action of the valve drive force is positioned on the specific straight line L10, the moment generated around the holder oscillating center line L3 to act on the holder 30 based on the valve drive force acting via the primary rocker arm 50 becomes zero. From this fact, while since the maximum lift amount is increased as the holder 30 approaches the primary limit position where the valve, operating property can be obtained where the maximum lift amount of the inlet valve 14 becomes maximum, the valve drive force is also increased, the moment acting on the holder 30 can be reduced by allowing the cam abutment position P1 on the cam lobe portion 21*b* to approach the specific straight line L10, and the drive force of the electric motor 28 which oscillates the holder 30 against the moment, whereby the electric motor 28 is made compact.

The valve abutment portion 64 abuts with the valve stem 14*a* of the inlet valve 14, and the holder oscillating center line L3 is disposed on the extension of the valve stem 14*a* which extends along the axis L7 of the valve stem 14*a*, whereby the distance between the holder oscillating center line L3 and the line of action of the reaction force F2 from the inlet valve 14 is maintained small within the range of the valve stem 14*a*, and therefore, the moment acting on the holder 30 can be reduced based on the reaction force F2, and in this respect, too, the embodiment can contribute to the reduction in driving force of the electric motor 28.

Next, referring to FIG. 9, a second embodiment of the invention will be described below. The second embodiment differs from the first embodiment mainly as to a primary rocker arm 50 and a holder oscillating center line, and the former is constructed basically the same as the latter as to the other features, and therefore, while the description of the same features will be omitted or briefly made, the description will be made as to different features of the-second embodiment. Note that like reference numerals are given to members, as required, which are like or correspond to those described in the first embodiment.

In the second embodiment, a roller 53 is disposed such that an cam abutment portion 52 of a primary rocker arm 50 may be positioned on a specific straight line 10 where a cam abutment position P1 passes through a holder oscillating center line L3 and a rotational center line L2 on an orthogonal plane.

Figure 9:
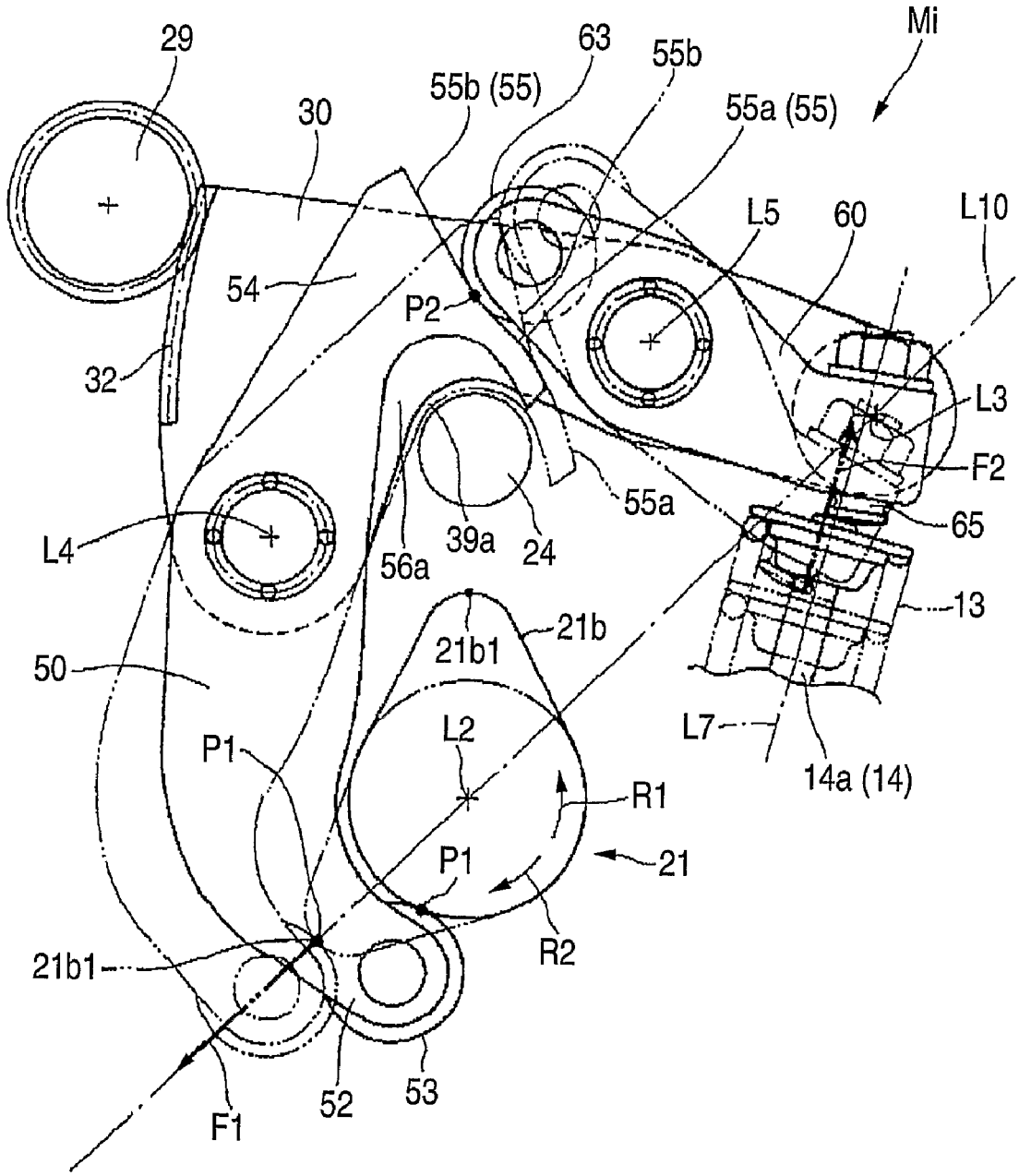
FIG. 9 is a drawing showing a second embodiment of the invention, which corresponds to FIG. 6.

To be specific, as shown in FIG. 9, when a holder 30 occupies a primary limit position, the cam abutment position P1 situated on an apex 21*b*1 of a cam lobe portion 21*b* is situated on the specific straight line L10. Therefore, the roller 53 is disposed such that as the oscillating position of the holder 30 approaches a predetermined position where a maximum valve operating property can be obtained where a maximum lift amount of an inlet valve 14 becomes maximum, the cam abutment position P1 residing at the apex 21*b*1 approaches the specific straight line L10.

Then, since when the cam abutment position P1 residing at the apex 21*b*1 is situated on the specific straight line L10, the line of action of a valve drive force F1 is situated on the specific straight line L10, a moment generated around the holder oscillating center line L3 to act on the holder 30 based on the valve drive force F1 becomes zero.

According to the second embodiment, similar functions and advantages to those in the first embodiment are provided, except for the fact that the valve operating properties are different, and in addition to the similar functions and advantages, the following function and advantage will also be provided.

By adopting the construction in which in a primary rocker arm, a cam abutment position 52 is disposed such that when the holder occupies the primary limit position, the cam abutment position P1 may be situated on the specific straight line L10, since when the cam abutment position P1 is situated on the specific straight line L10, the line of action of the valve drive force F1 is situated on the specific straight line L10, the moment generated around the holder oscillating center line L3 to act on the holder 30 based on the valve drive force F1 which acts via the primary rocker arm 50 becomes zero. Due to this, in the state where the cam abutment position P1 on the cam lobe portion 21*b* is situated on the specific straight line L10 and in the vicinity thereof, since the drive force of an electric motor 28 which causes the holder 30 to oscillate against the moment can be reduced, the electric-motor 28 is made compact.

Then, by adopting the construction in which the cam abutment position P1 is situated on the specific straight line L10 when the cam abutment position P1 resides at the apex 21*b*of the cam lobe portion 21*b*, since the moment acting on the holder 30 based on the maximum valve drive force F1 becomes zero at the specific oscillating position of the holder 30, the drive force of the electric motor 28 can be reduced further.

As to embodiments in which part of the constructions of the embodiments that have been described heretofore are changed, the changed constructions will be described below.

Instead of the inlet operation mechanism, the exhaust operation mechanism may be made up of the variable property mechanism, and both the inlet operation mechanism and the exhaust operation mechanism may be made up of the variable property mechanism. In addition, the valve train may be such as to include a pair of camshafts including, in turn, an inlet camshaft on which an inlet cam is provided and an exhaust camshaft on which an exhaust cam is provided. In the aforesaid embodiments, while the primary member which regulates the oscillating position of the secondary rocker arm 60 relative to the holder 30 is the primary oscillating member (the primary rocker arm 50) which is the oscillating member, the primary member may be a member which performs other movements than oscillation.

In stead of being formed on the drive abutment 54 of the primary rocker arm 50, the cam profile may be formed on the follower abutment portion 62 of the secondary rocker arm 60, and as this occurs, the portion, for example, a roller of the drive abutment portion of the primary rocker arm 50 is brought into abutment with the cam profile. The abutment surface such as the cam abutment portion or the follower abutment portion 62 may be made up of other sliding surfaces, whose sectional shape is something like an arc, than the roller. The primary and secondary rocker arms may be such as of a swing type. In addition, in the secondary rocker arm 60, the valve abutment portion having the valve abutment surface may be such as to have no adjustment screw.

The drive mechanism Md may be such as to include, instead of the drive gear 29*b*, a member or a link mechanism which is caused to oscillate by the drive shaft 29. In addition, the drive mechanism Md may be such as not to have the common drive shaft to all the cylinders and may be such as to have a drive shaft that is driven by a separate actuator for a specific cylinder. By adopting this construction, the operation of part of the cylinders can be brought to rest in accordance with the operating conditions.

The holder oscillating center line L3 may be set at a position where the center line L3 intersects at right angles with the axis L7 of the valve stem 14*a*. In addition, the position of the holder oscillating center line L3 may be set such that the reaction force F2 from the inlet valve 14 generates a moment acting in a direction in which the moment based on the valve drive force F1 is cancelled thereby.

While the minimum valve operating property Kb is such that the maximum lift amount becomes zero, the minimum valve operating property Kb may be a valve operating property where the maximum lift amount has a value other than zero.

The inlet cam 14 relative to the crankshaft or a variable phase mechanism which can change the phase of the camshaft 20 may be provided on the camshaft 20 or the valve transmission mechanism.

The holder 30 does not have to be made up of a separate member for each cylinder so as to be separate from one another but may be such that separate members are connected together by a connecting means or the holder 30 may be formed integrally for all the cylinders.

When the cam abutment position P1 is situated at the base circle portion 21*a*, by adopting the construction in which the cam abutment portion is disposed such that the cam abutment position P1 is situated on the specific straight line L10, a valve operating property can be obtained which has longer valve opening period and larger maximum valve properties than the valve operating properties obtained by the first embodiment.

In addition, while, in the second embodiment, in the state where the holder 30 is situated at the primary limit position, when the cam abutment position resides at the apex of the cam lobe portion, the cam abutment portion is disposed such that the cam abutment position is situated on the specific straight line, in a state where the holder is situated at any other oscillating positions than the primary limit position, the cam abutment portion may be disposed such that the cam abutment position situated at the apex of the cam lobe portion is positioned on the specific straight line or the cam abutment position situated at any other locations on the cam lobe portion than the apex is situated on the specific straight line.

The internal combustion engine may be a single-cylinder one and may be applied to equipment other than vehicles, for example, to a marine propelling apparatus such as outboard engines having a crankshaft which is directed in a perpendicular direction.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

The invention claimed is:

1. A valve train for an internal combustion engine, comprising:

a valve operating cam rotating around a rotational center line in synchronism with a rotation of the engine;

an engine valve including at least one of an inlet valve and an exhaust valve;

a transmission mechanism for transmitting a valve drive force of the valve operating cam to the engine valve so as to operate the engine valve in opening and closing states, the transmission mechanism including:

a primary oscillating member having an abutment portion which abuts with the valve operating cam, and oscillating about a primary oscillating center line by the valve operating cam;

a secondary oscillating member having a valve abutment portion which abuts with the engine valve, transmitting the valve drive force via the primary oscillating member to the engine valve, and oscillating about a secondary oscillating center line;

a holder supporting the primary and secondary oscillating members in an oscillatory fashion so that the primary and secondary oscillating center lines rotate together therewith, and oscillating about a holder oscillating center line which is different from the rotational center line of the valve operating cam;

a drive mechanism for driving the holder so as to control valve properties including opening and closing timings and maximum lift amount of the engine valve in accordance with an oscillating position of the holder;

wherein as the oscillating position of the holder approaches a predetermined position where a valve operating property where a maximum lift amount becomes maximum is obtained, a cam abutment position where a cam lobe portion of the valve operating cam and the cam abutment portion abut with each other approaches a specific straight line which passes through the holder oscillating center line and the rotational center line.

2. The valve train for the internal combustion engine as set forth in claim 1, wherein the valve abutment portion having a valve abutment surface which abuts with the engine valve is provided at a position which intersects with the holder oscillating center line.

3. The valve train for the internal combustion engine as set forth in claim 1, wherein the valve abutment portion abuts with a valve shaft of the engine valve, the holder oscillating center line is disposed on an extension of the valve shaft which extends along an axis of the valve shaft, and when the cam abutment position is situated at an apex of the cam lobe portion, the cam abutment position is situated on the specific straight line.

4. The valve train for the internal combustion engine as set forth in claim 1, wherein the valve abutment portion abuts with a valve shaft of the engine valve, the holder oscillating center line is disposed on an extension of the valve shaft which extends along an axis of the valve shaft, and the cam abutment port-ion is disposed such that the cam abutment position is capable of being situated on the specific straight line which passes through the holder oscillating center line and the rotational center line.

* * * * *